US012714902B2

(12) United States Patent
Crowther et al.

(10) Patent No.: US 12,714,902 B2
(45) Date of Patent: Aug. 25, 2026

(54) FITNESS CABLE TENSIONING APPARATUS, SYSTEMS, AND METHODS OF USE

(71) Applicant: Bare Mechanics LLC, San Francisco, CA (US)

(72) Inventors: James Matthaei Crowther, San Francisco, CA (US); Leland William Crowther, San Francisco, CA (US)

(73) Assignee: Bare Mechanics LLC, San Francisco, CA (US)

( * ) Notice: Subject to any disclaimer, the term of this patent is extended or adjusted under 35 U.S.C. 154(b) by 0 days.

(21) Appl. No.: 18/414,220

(22) Filed: Jan. 16, 2024

(65) Prior Publication Data

US 2024/0238637 A1 Jul. 18, 2024

Related U.S. Application Data

(60) Provisional application No. 63/479,943, filed on Jan. 13, 2023.

(51) Int. Cl.

| | |
|---|---|
| ***A63B 21/00*** | (2006.01) |
| ***A63B 21/02*** | (2006.01) |
| ***A63B 21/04*** | (2006.01) |

(52) U.S. Cl.

CPC ..... *A63B 21/153* (2013.01); *A63B 21/025* (2013.01); *A63B 21/0435* (2013.01); *A63B 21/157* (2013.01); *A63B 2209/08* (2013.01)

(58) Field of Classification Search

USPC ..... 182/237; 119/796, 794, 781, 772, 770; 242/371, 376, 378.2, 379, 372, 396.4; 74/505, 506, 501.5 R, 575, 577 R, 577 S; 482/129, 102

See application file for complete search history.

(56) References Cited

U.S. PATENT DOCUMENTS 2,217,323 A * 10/1940 Sackett ..... B65H 75/4444 242/379.2
4,114,874 A * 9/1978 Mattila ..... A63B 21/00069 254/374
4,688,825 A * 8/1987 Arbogast ..... B60R 22/41 242/376
4,974,836 A * 12/1990 Hirsch ..... A63B 21/154 482/40
5,683,054 A * 11/1997 Chen ..... B65H 75/44 242/379

(Continued)

OTHER PUBLICATIONS

"Railtrainer Fitness (@railtrainerfitness)", Instagram [online], 2024 [retrieved on Apr. 11, 2024]. Retrieved from the Internet: <URL: <https://www.instagram.com/railtrainerfitness/>, 2 pages.
"ANCORE Pro", ANCORE [online]. ANCORE, 2024 [retrieved on Apr. 11, 2024]. Retrieved from the Internet: <URL: <https://ancoretraining.com/products/ancore-pro>, 7 pages.
"TONAL", TONAL [online] 2024 [retrieved on Apr. 11, 2024]. Retrieved from the Internet: <URL: <https://www.tonal.com/> 8 pages.

(Continued)

*Primary Examiner* — T. Scott Fix
(74) *Attorney, Agent, or Firm* — Beyer Law Group LLP

(57) ABSTRACT

The present disclosure surrounds a fitness cable tensioning apparatus which is used in conjunction with one or more pulleys and additional apparatus for use in conducting cable-based fitness movements in. The fitness cable tensioning apparatus can be used in conjunction with a weight-lifting rack, or with any other structure to which the fitness cable tensioning apparatus can be interconnected. The fitness cable tensioning apparatus as disclosed allows a user to modularly store, configure, and employ the apparatus in fitness exercises.

25 Claims, 41 Drawing Sheets

(56) References Cited

U.S. PATENT DOCUMENTS

| | | | | |
|---|---|---|---|---|
| 6,368,262 | B1 * | 4/2002 | Willoughby | E05B 75/00 119/796 |
| 8,727,952 | B1 * | 5/2014 | Carle | A63B 21/0628 482/99 |
| 2011/0089281 | A1 * | 4/2011 | Boyd | B65H 75/406 242/390.8 |
| 2013/0267392 | A1 * | 10/2013 | Miranda | A63B 71/02 482/102 |
| 2013/0288861 | A1 * | 10/2013 | Cole | A63B 21/0618 482/102 |
| 2015/0343254 | A1 * | 12/2015 | Djang | A63B 21/4025 482/102 |

OTHER PUBLICATIONS

"MAXPRO", MAXPRO [online], MAXPRO Fitness 2024 [retrieved on Apr. 11, 2024]. Retrieved from the Internet: <URL: <https://maxprofitness.com/>, 15 pages.

"Trainer+ (3 Months All Access Membership included)", Vitruvian Trainer+ [online]: [retireved on Apr. 11, 2024]. Retrieved from the Internet: <URL: <https://vitruvianform.com/products/trainer-all-access-membership-included?variant=40584406564957>, 10 pages.

"Voltra I", Beyond Power [online], Beyond Power Inc. 2024: [retrieved on Apr. 11, 2024]. Retrieved from the Internet: <URL: <https://www.beyond-power.com/products/voltra>, 18 pages.

* cited by examiner

100

100

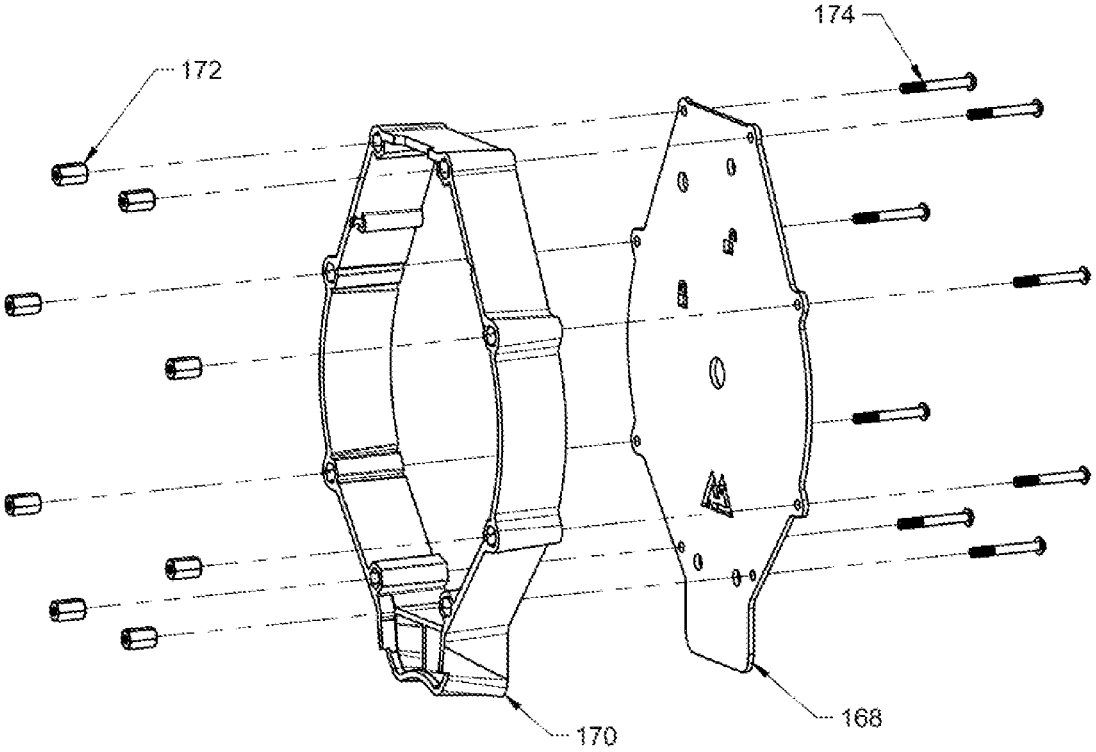
FIG. 4
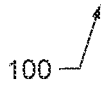

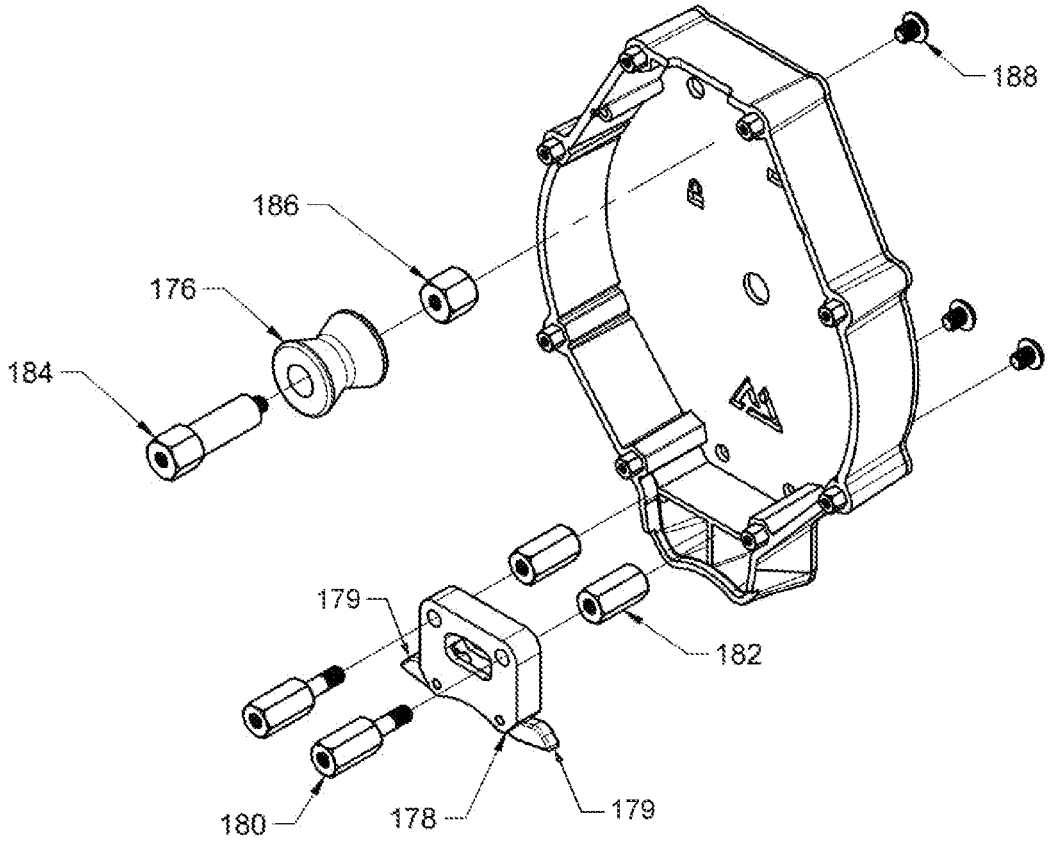
FIG. 5
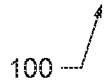

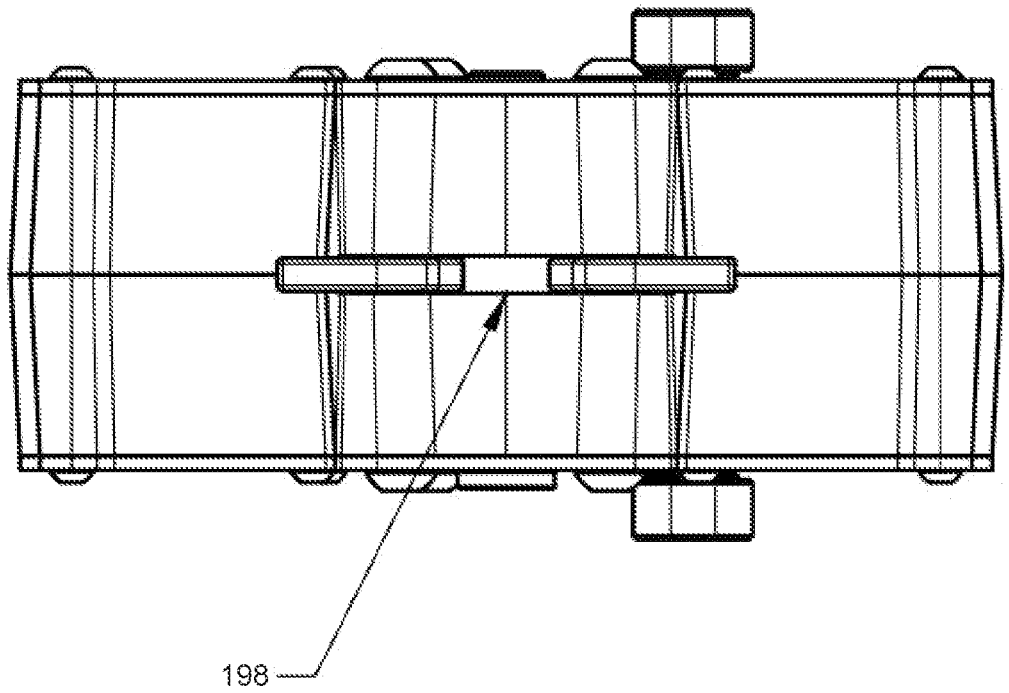
FIG. 8
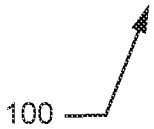

DETAIL A

FITNESS CABLE TENSIONING APPARATUS, SYSTEMS, AND METHODS OF USE

CROSS REFERENCE TO RELATED APPLICATIONS

This application claims the benefit of U.S. Provisional Patent Application No. 63/479,943 entitled "FITNESS CABLE TENSIONING APPARATUS" filed on Jan. 13, 2023, the entire contents of which is incorporated herein by reference in its entirety for all purposes.

TECHNICAL FIELD

The present invention is directed to fitness equipment, and more specifically a fitness tether training apparatus configured to manage loads associated with fitness movements requiring a tensioned element, such as a cable, interconnecting between a handle, and weights optionally selected by the user.

BACKGROUND

As related to fitness training as related to exercises intended to train or work-out particular muscle groups using weight resistance, there are three commonly used exercise types.

A first exercise type surrounds body weight exercises which rely on the body weight of the user as a resistance source. Body weight exercises can be further modified for increased or reduced difficulty by using elements such as elastic fitness bands. A second exercise type uses weights which are not tethered in any fashion, commonly referred to as "free weights" and surround the use of elements such as dumbbells, barbells, weight plates, and kettlebells. A third exercise type, the focus of the present disclosure, surrounds the use of tethered or cable-based exercises, such that a cable is tethered to one or more weights or other resistance elements (e.g. elastic bands) and involve one or more pulleys to change the direction of the applied force of the user to a handle end of the cable in a desired direction while conducting one or more particular movements, often in a repeated manner, to counteract the resistance (e.g. lift a weight).

The present disclosure is directed toward allowing a user to easily modify resistance of a particular exercise (e.g. force required to conduct an exercise) connected to a first end of a tether, and to allow a user to further modify the routing of the tether, and height, angle, and starting position of the second end of a tether which the user moves in association with the one or more particular movements associated with the exercise.

SUMMARY

Cable based machines are commonly used in many gyms as they provide specific fitness movements which may otherwise be difficult to perform, and provide near constant resistance throughout the range of motion of the particular exercise for which the cable machine is adapted.

For instance, a common cable-based exercise, commonly referred to as a "lat-pull-down" which mimics the motion associated with performing a pull-up. While a lat-pull-down can be performed with a load exceeding a user's body-weight, it can also be performed with loads less than the user's weight and does not require a user to be able to perform a pull-up. The lat-pull-down involves a wide grip distance between the user's hands in which the user pulls vertically downward from a seated position on an overhead handle in a motion that engages primarily the latissimus dorsi, the largest muscle in the back, as well as biceps, rear deltoids, rhomboids and trapezius muscles in a movement which mimics a pull-up. The user's motion of the handle in a downward motion, through a series of pulleys guiding a cable connecting the handle with a weight-stack, results in the lifting of the weight-stack. However, a traditional cable machine which is adapted for a particular movement is not easily adaptable for a different movement.

Furthermore, traditional self-standing cable machines are complex systems that use a significant number of components and are large in volume. This leads to high manufacturing and shipping costs, and in gyms their large footprint is undesirable in addition to their limited functionality.

An existing cable machine adapted for a lat-pull-down, is only useful for movements which require pulling downward on an overhead handle from a single overhead location. In the event a user wishes to use the same machine for a movement which requires the movement to begin at a different height, or in the event the user is unable to reach the starting position of the handle end, the user stands and pulls the handle down to a seated position prior to commencing the workout. If the user wishes to perform a cable-based exercise which requires a different configuration for a different muscle group (e.g. pulling upward to lift a weight stack), the user must use a different machine entirely.

It is an aspect of one or more embodiments of present disclosure to provide a fitness cable tensioning apparatus which allows a user to easily modify the length of a tether in a manner which allows a user to adapt the length of the tether, and thus the starting position of the handle end of the tether.

Some alternatives have been developed to address the high cost and large footprint of self-standing cable machines. Among these solutions, there is a category of rack mounted cable systems which utilize the squat rack or power rack frame, referred to herein as a "rack", commonly associated with Olympic weightlifting which typically includes four upright posts interconnected with horizontal members, on which accessories can be modularly mounted for supporting weightlifting bars as associated with performing movements such as weighted squats.

Certain rack mounted cable systems are simplistic systems with a fixed length cable which is guided by one or more pulleys mounted to a rack in a manner that a user pulls on a handle end of the cable, which results in the lifting of one or more weights connected with the weighted end of the cable. Such systems are problematic as efforts to adjust the starting position of the handle end are complicated by the fixed length cable. For instance, in the event a user wishes to change the starting position of the handle end (e.g. raising the handle end) the adjustment results in slack in the cable which may result in the cable disengaging from one or more of the pulleys and results in the user needing to reestablish the cable routing, and possibly installing one or more additional pulleys to address the slack. Alternatively, moving the handle end down, for instance, results in requiring a longer cable resulting in a user needing to change out a cable, or removing one or more pulleys to provide additional slack in the system.

Alternatively, certain rack mounted cable systems utilize a closed loop cable system which allows a user to easily adjust the starting location of the handle end in relation to the weighted end. This is accomplished by running a cable from the pull location around a series of rack mounted pulleys and the load, and then back to the pull location creating a closed cable loop. This closed cable loop ensures the cable stays tensioned when the user adjusts the pull location. However, a closed loop cable system requires a complex cable run through many pulleys mounted throughout the rack, and the increased number of pulleys and hardware result in increased system friction and often prohibitive cost.

It is an aspect of one or more embodiments of the present disclosure to provide a cable-based tensioning apparatus, and associated systems and methods, which allow a reconfigurable and modular system which allows a user to easily and rapidly reconfigure the apparatus and system for desired cable-based exercises without challenges commonly associated with existing solutions.

These and other advantages will be apparent from the disclosure of the embodiments contained herein. The above-described embodiments, objectives, and configurations are neither complete nor exhaustive. As will be appreciated, other embodiments of the disclosure are possible using, alone or in combination, one or more of the features set forth above or described in detail below. Further, this Summary is neither intended nor should it be construed as being representative of the full extent and scope of the present disclosure. The present disclosure is set forth in various levels of detail in this Summary, as well as in the attached drawings and the detailed description below, and no limitation as to the scope of the present disclosure is intended to either the inclusion or non-inclusion of elements, components, etc. in this Summary. Additional aspects of the present disclosure will become more readily apparent from the detailed description, particularly when taken together with the drawings, and the claims provided herein.

DETAILED DESCRIPTION OF VARIOUS EMBODIMENTS

Figure 1:
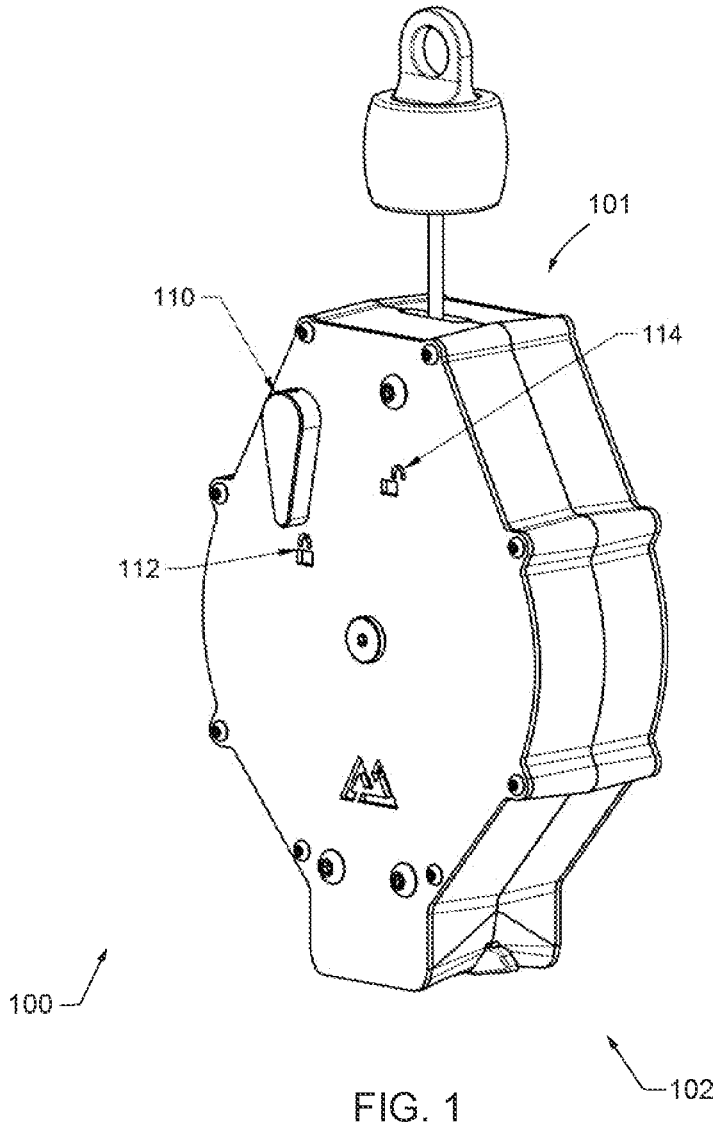
FIG. 1—A perspective view of one or more embodiments of a cable tensioning apparatus of the present disclosure FIG. 2—An exploded perspective view of one or more embodiments of a cable tensioning apparatus FIG. 3—An exploded perspective view of certain portions one or more embodiments of a cable tensioning apparatus FIG. 4—An exploded perspective view of certain portions of one or more embodiments of a cable tensioning apparatus FIG. 5—An exploded perspective view of certain portions of one or more embodiments of a cable tensioning apparatus FIG. 6A—A first perspective view of one or more embodiments of a shaft for the cable tensioning apparatus FIG. 6B—A second perspective view of one or more embodiments of the shaft for the cable tensioning apparatus shown in FIG. 6A FIG. 6C—An end view of one or more embodiments of the shaft for the cable tensioning apparatus shown in FIG. 6A-FIG. 6B FIG. 7—A top view of one or more embodiments of a cable tensioning apparatus FIG. 8—A bottom view of an exemplary cable tensioning apparatus FIG. 9—A perspective view of one or more embodiments of the cable tensioning apparatus with an exemplary rack system comprising two posts FIG. 10—A perspective view of one or more embodiments of a cable tensioning apparatus shown assembled with a rack mounted system on an exemplary rack comprising 4-posts FIG. 11—An exploded perspective view of an exemplary extension arm component of one or more embodiments configured for use in a rack mounted system FIG. 12—An exploded perspective view of an exemplary extension arm component of one or more embodiments configured for use in a rack mounted system FIG. 13—An exploded perspective view of exemplary hardware for mounting an extension arm component to a rack in one or more embodiments FIG. 14—A perspective view of an exemplary carriage component of a system of one or more embodiments FIG. 15—An exploded perspective of an exemplary carriage component of a system of one or more embodiments FIG. 16—An exploded perspective of an exemplary carriage component of a system of one or more embodiments FIG. 17—An exploded perspective of at least a portion of an exemplary carriage component of a system of one or more embodiments FIG. 18—A perspective view of an exemplary load pin of one or more embodiments of the present disclosure FIG. 19—A perspective view of an exemplary rack mounted cable system of one or more embodiments comprising a cable tensioning apparatus installed on a two-post rack, in a stored configuration FIG. 20—A perspective view of the exemplary rack mounted cable system shown in FIG. 19 in the stored configuration with one or more weights on the load pin FIG. 21—A perspective view of the exemplary rack mounted cable system shown in FIG. 20 with the cable tensioning apparatus connected to the load pin FIG. 22—A perspective view of the exemplary rack mounted cable system shown in FIG. 21 with the carriage assembly height optionally modified to an intermediate height and handle interconnected to a second end of the cable FIG. 23—A perspective view of the exemplary rack mounted cable system shown in FIG. 22 with the handle pulled away from the carriage assembly resulting in lifting weight off the ground (user is not shown)
Figure 2:
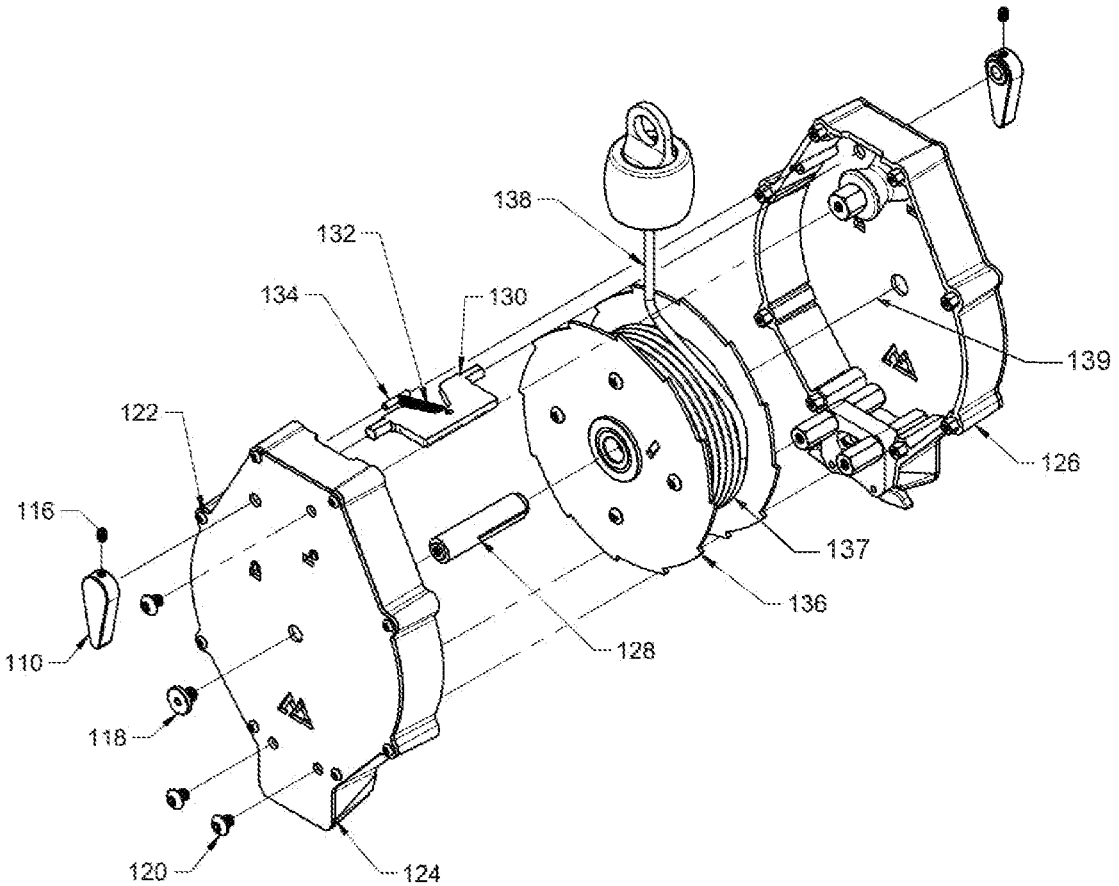

In one or more embodiments of the present disclosure fitness cable tensioning apparatus 100 as shown in FIG. 1-FIG. 8 allows the adjustability of cable length for the use in different fitness exercises. As illustrated in FIG. 2 for instance, the cable tensioning apparatus of one or more embodiments comprises a spool assembly 136 which is configured to receive and release a cable assembly 138 interconnected thereto. One or more embodiments optionally comprise a housing 124 and 126 which are optionally constructed of multiple parts, wherein the housing encloses the spool assembly. While a generally closed housing is described and shown herein, a generally open housing (e.g. a housing comprising a skeletal frame), such as but not limited to a plurality of linear segments interconnecting the back plates 168 (see FIG. 4), or a series of linear and/or curvilinear segments interconnected to create a housing are within the spirit and scope of the present disclosure. The housing of alternate embodiments comprising one part, and embodiments which do not include a housing are within the spirit and scope of the present disclosure.

In one or more embodiments a fitness cable tensioning apparatus 100 further comprises a shaft 128 that is fixed to the front housing via a screw 118, a ratchet latch 130 (also referred to herein as a pawl), a spring 132 (e.g. an extension spring) that connects from the pawl to the housing via a rod 134, wherein the spring 132 acts as a pawl limiting device to maintain the pawl in a locked configuration, and/or an unlocked configuration. The fitness cable tensioning apparatus of one or more embodiments further comprises one or more lock/unlock pawl toggle(s) 110 (also referred herein as a pawl toggle), a set screw(s) 116 to secure the toggle knob(s), and button head screws 120 and 122 used to connect the front and back housing assemblies together. Furthermore, the screw 120 and 122 are optionally used to interconnect the first connector portion 178 (FIG. 5) to the fitness cable tensioning apparatus 100. In one or more embodiments, the pawl, rod and shaft each are optionally constructed from steel. However alternative embodiments including a lock/unlock pawl toggle optionally comprise an aluminum or plastic construction.

Figure 3:
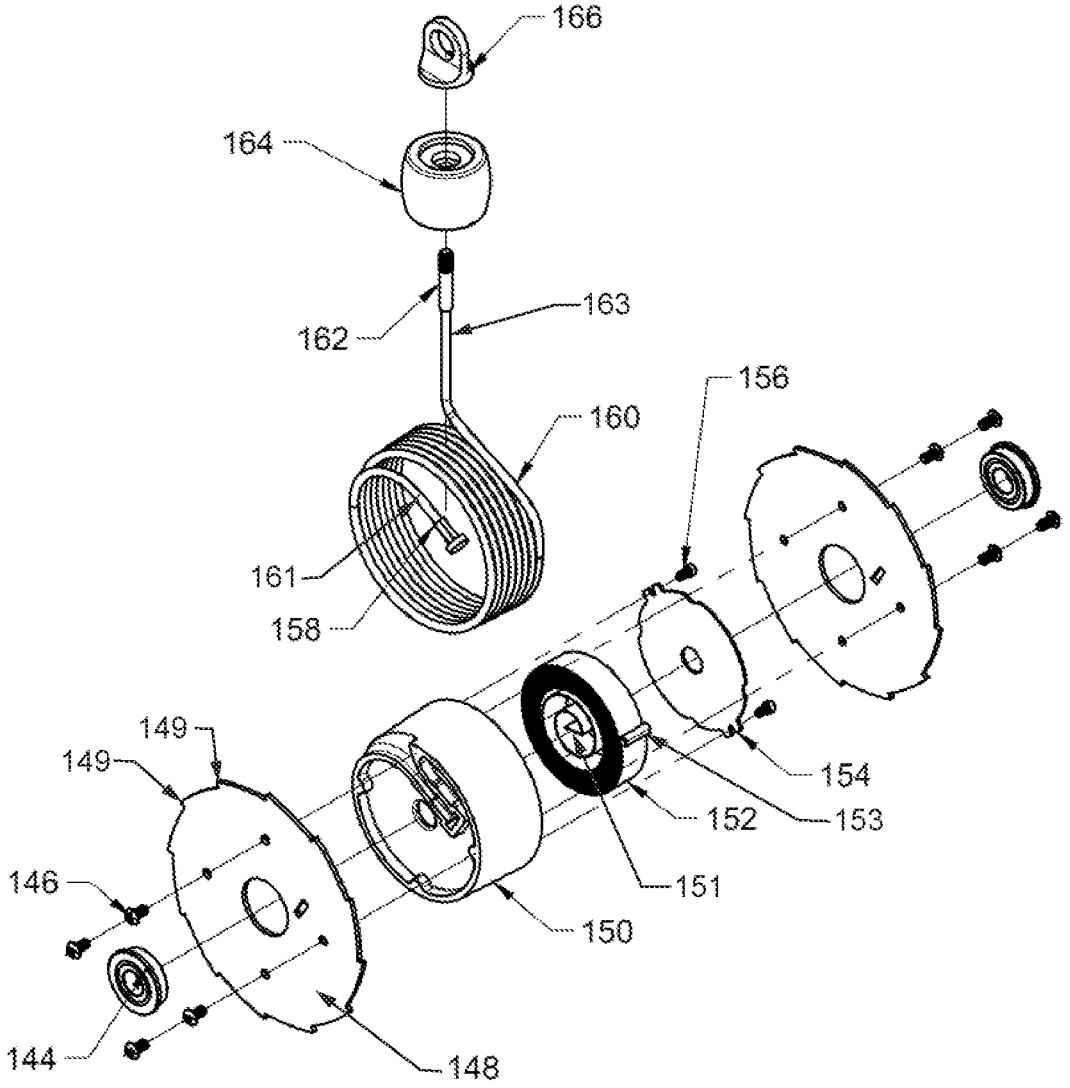
Figure 6A:
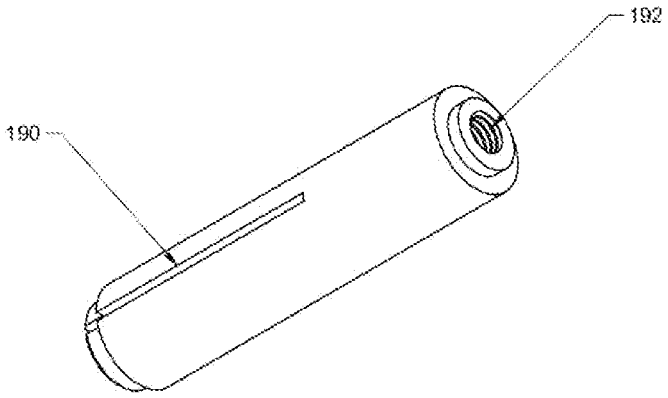
Figure 6B:
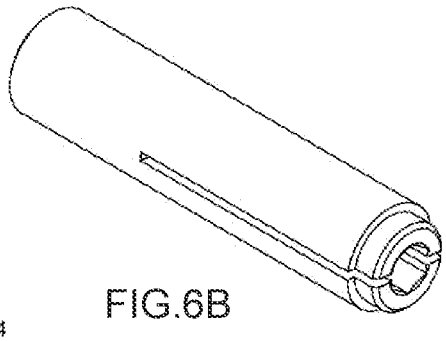
Figure 6C:
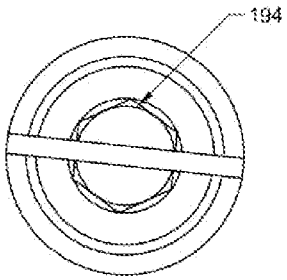
Figure 28A:
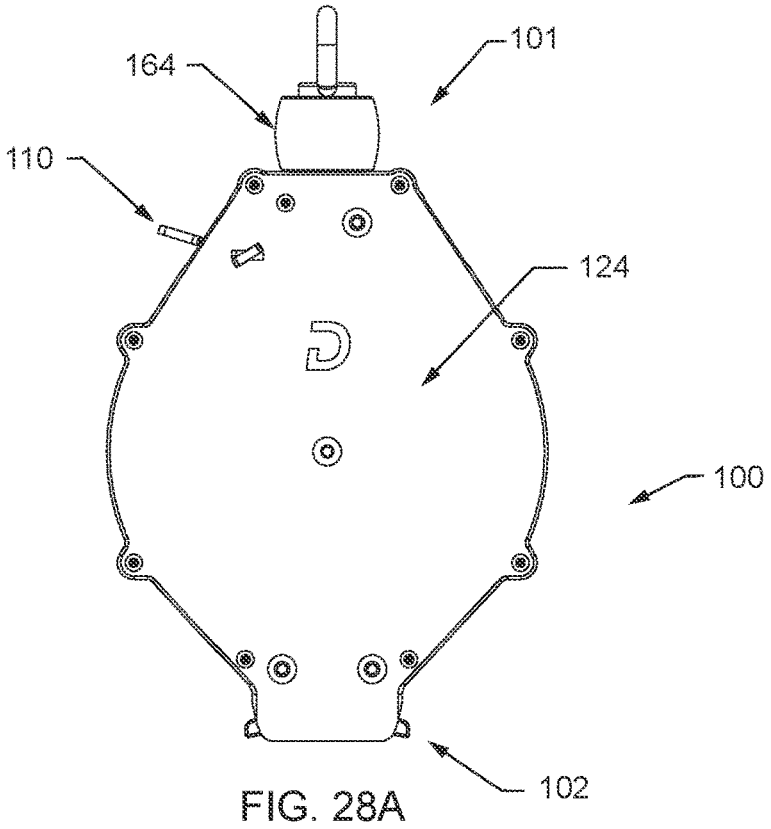
Figure 28B:
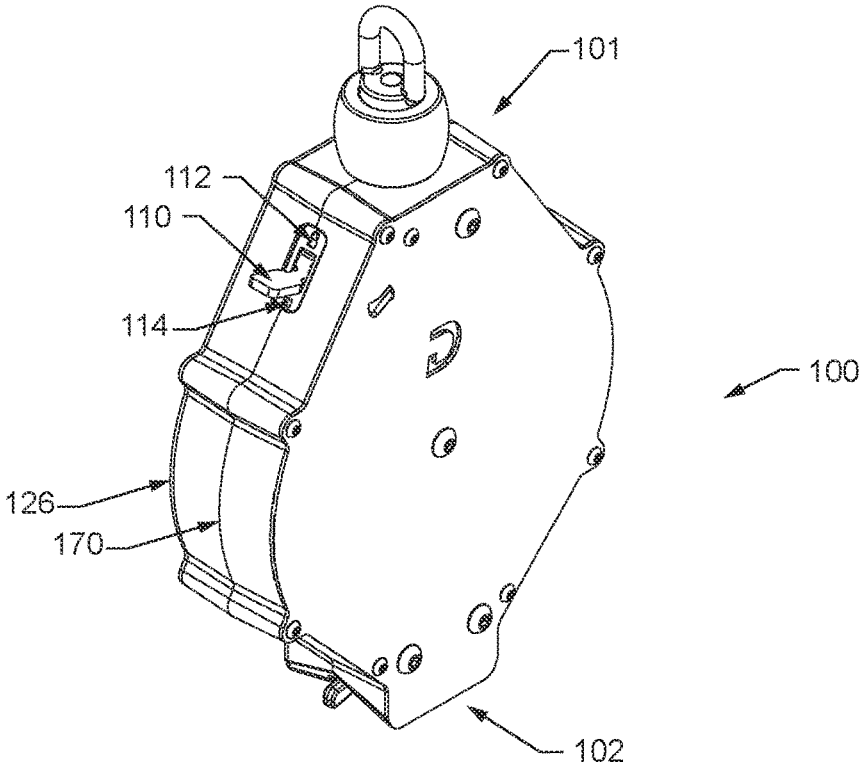
Figure 28C:
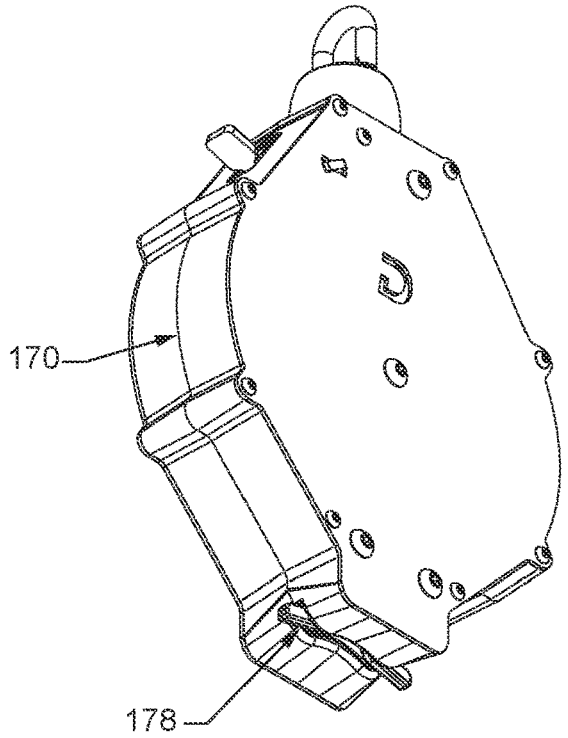
Figure 28D:
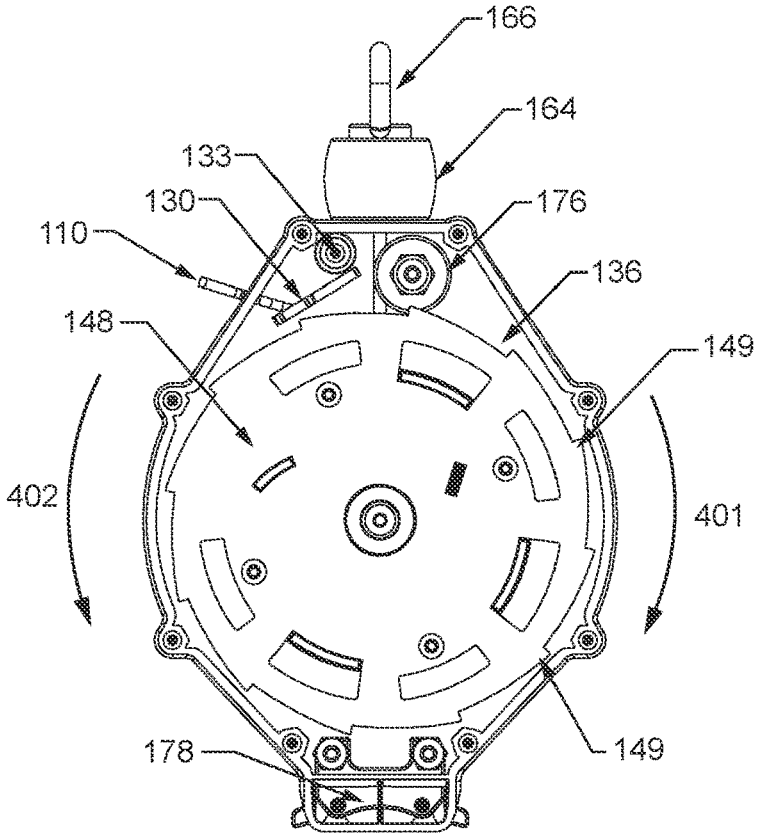

One or more embodiments, as illustrated for instance in FIG. 3, a fitness cable tensioning apparatus 100 comprises a spool assembly 136 which is adapted for receiving a cable 138 around the perimeter of the spool assembly 136. One or more embodiments of the present disclosure, the fitness cable tensioning apparatus further comprises a power spring 152 which optionally comprises a stainless-steel construction. The power spring 152 is configured to induce the rotation of the spool assembly 136 in a first rotational direction 401 (see FIG. 28D), wherein rotation of the spool assembly 136 in the first rotational direction 401 results in the retraction of the cable 138 and the wrapping of the cable around the hub 150. The power spring 152 of one or more embodiments is contained by the hub 150 and a spring retainer plate 154 which is secured with socket head screws 156. The tail 153 of the power spring connects with (e.g. hooks) the hub 150, and the center 151 of the power spring connects with a shaft 128 wherein the connection between the power spring 152 and the shaft 128 prevents the center 151 of the power spring from rotating in relation to the tail 153 of the power spring, wherein the rotation wherein the rotation of the spool assembly 136 around the shaft 128 results in the loading and unloading of the power spring. The hub is optionally constructed from cast aluminum and the spring retainer is optionally constructed of laser cut steel or aluminum, but not limited thereto. Alternatively, the hub is optionally constructed from injection molded plastic (e.g. nylon), and alternatively still the hub of one or more embodiments is potentially constructed with plastics such as Polytetrafluoroethylene (PTFE), Acetal, Nylon, Delrin®, Teflon®, High Density Polyethylene (HDPE), and/or Ultra-High Molecular Weight Polyethylene (UHMWPE).

In one or more embodiments, illustrated in FIG. 3 for instance, each side of the hub 150 comprises a flange 148 comprising gear teeth 149 which are fixed using screws 146. In one or more embodiments, the toothed flanges are optionally laser cut steel, but are not limited thereto. As illustrated in FIG. 3 for instance, in one or more embodiments, bearings 144 (e.g. ball bearing, brass bushing, polymeric bushings) are pressed into the flanges 148 in order to allow the rotation of the hub under when a load is applied via the cable 160. In one or more embodiments, the cable 160 comprises a fitting (e.g. a T-shaped cross section fitting 158) interconnected to the first end 161 wherein the first end 161 of the cable is secured between the hub and one of the flanges thereby preventing the first end 161 of the cable from moving in relation to the spool 136. Accordingly, as the spool 136 rotates, the cable 160 is wrapped and or unwrapped around the spool depending on which direction the spool rotates. When the spool 136 rotates in the first direction 401 (FIG. 28D) , the cable is wrapped around the spool 136. Alternatively, when the hub 150 rotates in the second direction 402 (FIG. 28D), the cable is unwrapped from the spool 136. In one or more embodiments the cable comprises a plastic-coated steel cable, but is not limited thereto.

In one or more embodiments, as shown in FIG. 3 for example, user interfacing end of the cable (e.g. the second end 163) optionally comprises a threaded fitting 162 swaged on, a bumper 164 (e.g. a ball with a hole therethrough) slid over it, and a threaded loop fitting (e.g. an eyelet 166) so that the user can attach handles. A handle, as referred to herein, optionally refers to a structure, device or accessory configured to interconnect to the second end of the cable wherein a user applies load to the second end of the cable (e.g. handle, weight belt, vest, harness, yoke, barbell).

Referencing FIG. 1-FIG. 3, one or more embodiments of the fitness cable tensioning apparatus 100 is configured to prevent the slacking of the cable 160 wherein the power spring 152 will apply a torque configured to rotate the spool assembly 136 in the first direction causing the spool assembly 136 to wind-up the cable 160 around the spool hub 150 at all times. When the pawl 130 is engaged in a locked configuration (e.g. pawl toggle 110 pointed towards locked icon 112), the spool 136 is able to rotate and wind up the cable, and the pawl 130 engages with gear teeth 149 interconnected to the gear teeth 149 to prevent the cable from unwinding. When the pawl 130 is disengaged in an unlocked configuration (e.g. pawl toggle 110 pointing towards the unlocked icon 114), the user can extend the effective length of the cable 160 by unwinding the cable 160 from the spool 136 to the desired length. Although the cable 160 is unwrapped from the spool 136, the power spring 152 maintains resistance in the opposite direction and prevents the cable from becoming slack such as when the cable 160 is yanked or released. Accordingly, the user is able to optionally lock the cable tensioning apparatus when they wish to pull on the cable against a load interconnected to the fitness cable tensioning apparatus 100, and alternately unlock the fitness cable tensioning apparatus 100 when they wish to adjust the pull location (i.e. cable length). The effective cable length as discussed herein, for instance, relates to the amount of cable 160 which extends out from the fitness cable tensioning apparatus 100.

One or more embodiments as illustrated by FIG. 4 for instance, comprise a housing which includes a back plate 168 which is fixed to a plastic housing 170 using screws 174 which pass through both the back plate 168 and the housing 170 wherein the screws thread into female threaded hex standoffs 172. In one or more embodiments the hex standoffs are inset within hex shaped cavities in the housing 170 which prevent rotation of the standoff. Alternatively, in one or more embodiments the metal plate may be laser cut steel. Furthermore, one or more embodiments of the present disclosure optionally comprise a housing 170 which comprises injection molded plastic.

Figure 7:
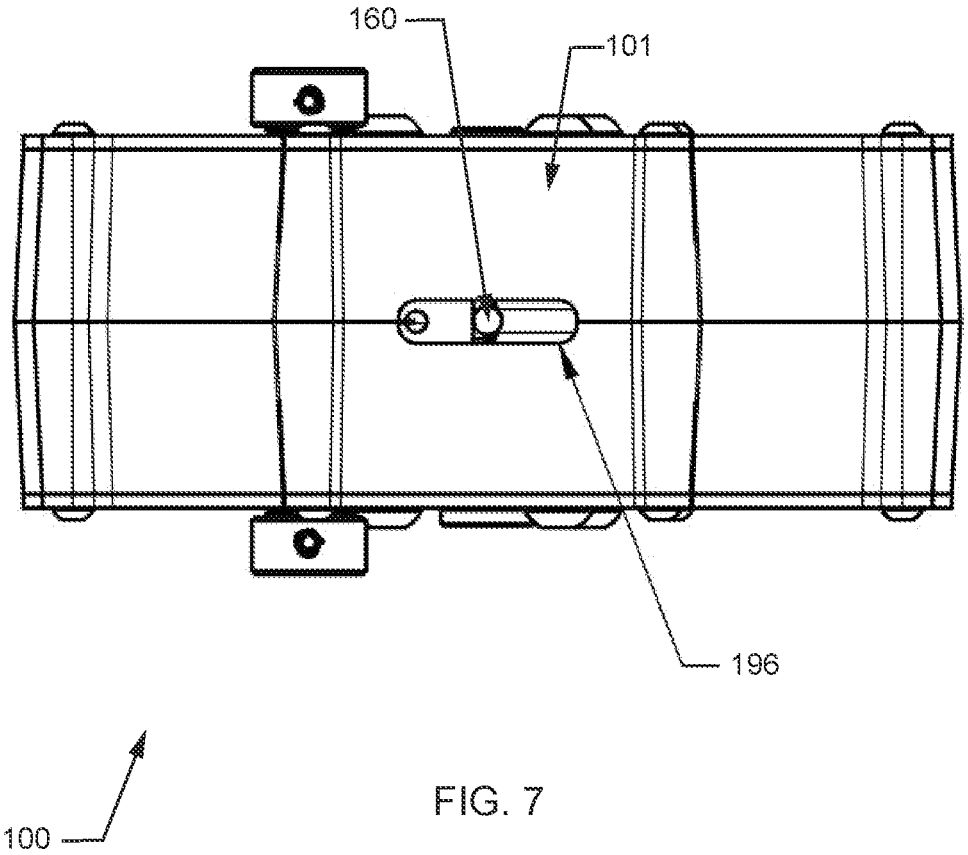

In one or more embodiments, as shown in FIG. 5 for instance, a cable guide 176 is interconnected to the fitness cable tensioning apparatus 100 which is configured to guide the extension and retraction of the cable through an aperture 196, shown for instance in FIG. 7, present in the first end 101 of the housing to allow the cable to extend and retract through the aperture and onto the spool 136. In one or more embodiments of the present disclosure, the aperture 196 comprises a slot-shaped opening, but is not limited thereto.

Referencing FIG. 5 and, FIG. 7-FIG. 8., one or more embodiments of the present disclosure comprise a first connector portion 178 interconnected to the second end of the fitness cable tensioning apparatus 100 wherein the first connector portion is configured to interconnect to a load comprising a second connector portion to be lifted by a force applied to the cable 160. The connector 178 provides a first connector portion which is configured to interconnect to a second connector portion. As shown, the first connector portion 178 comprises a female buckle connector which is configured to interconnect to the second connector portion comprising a male buckle portion. In one or more embodiments the first connector portion 178 comprises a female buckle portion wherein an opening 198 is configured to receive a male portion of a buckle 300 (see FIG. 18 for instance).

In one or more embodiments, shown in FIG. 5 for instance, female hex standoffs 182 and 186, male standoffs with an extended cylindrical portion 180 and 184, and screws 188 are used to attach the buckle and the cable guide assembly.

In one or more embodiments of the present disclosure, referencing FIG. 2-FIG. 3 and FIG. 6A-FIG. 6C for instance, the spool is configured to rotate about a shaft 128 wherein a screw is configured to attach through the housing 124 to interconnect with a first end 192 of shaft wherein a center 151 of the power spring is configured to slide into a slot 190 of the shaft to retain the power spring to the shaft. Furthermore, a second end 194 of the shaft comprises a recess configured to receive a tool (e.g. a hex allen wrench) to rotate the spool and load the power spring by rotating it in a first rotational direction.

Figure 9:
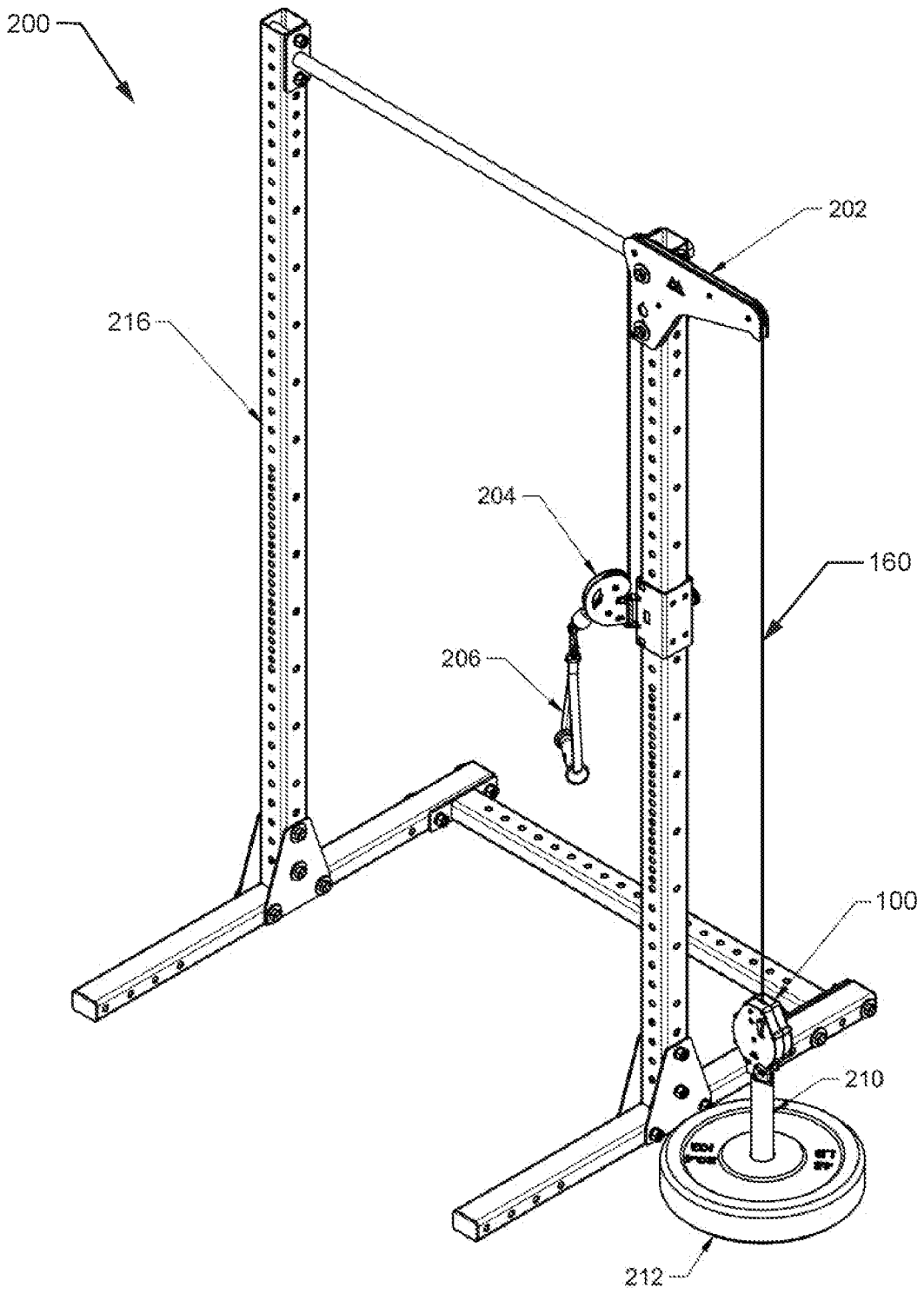
Figure 10:
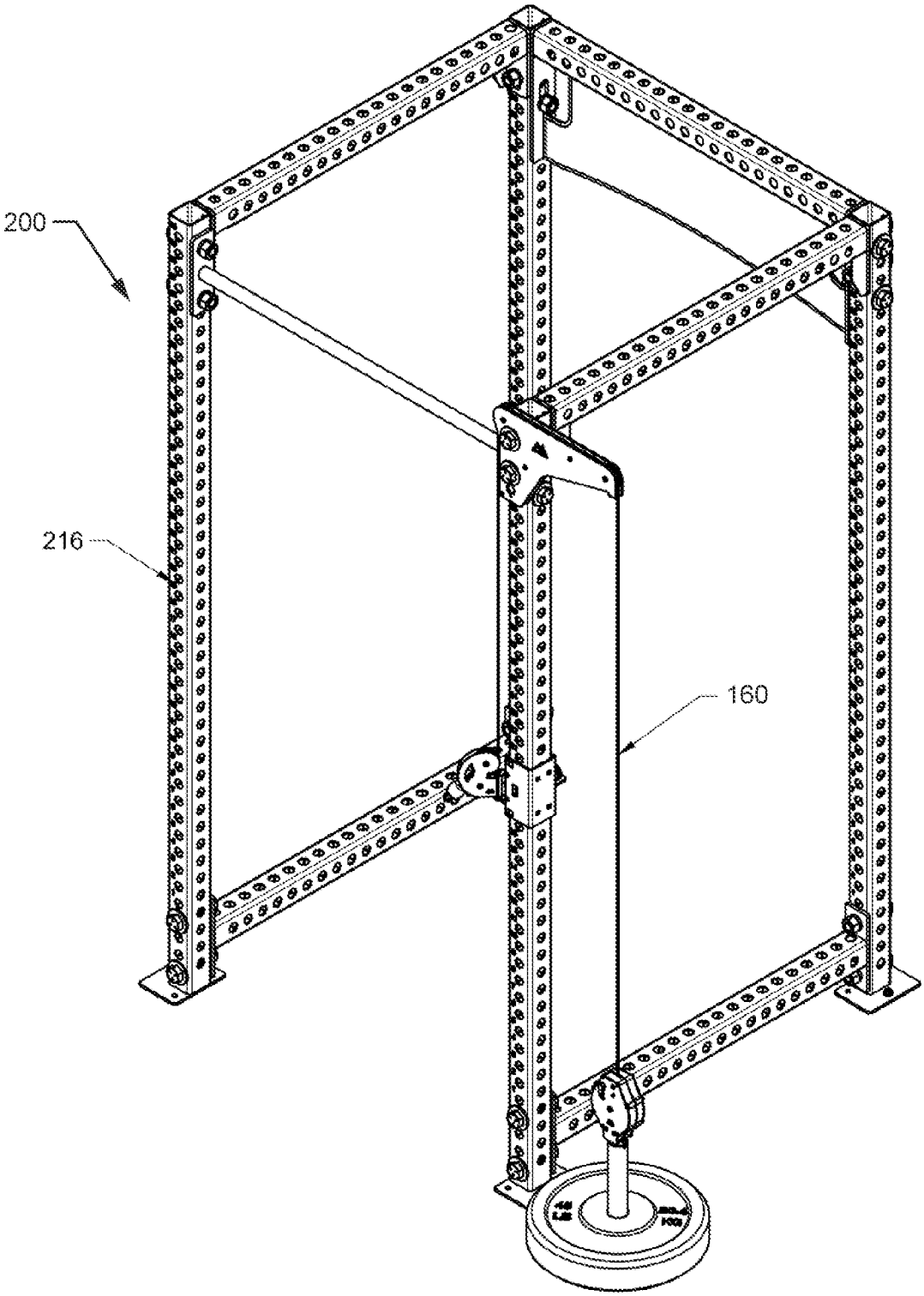

In one or more embodiments the fitness cable tensioning apparatus 100 is used in a rack mounted cable system configuration as shown in FIG. 9-FIG. 10 and further shown in FIG. 24A-FIG. 25D wherein the fitness cable tensioning apparatus 100 and other components are interconnected to an existing rack for instance. The racks shown are exemplary 2-post and 4-post racks, but the use of the present disclosure is not limited to the interconnection to such examples. The embodiments shown comprise an extension arm 202 which is configured to allow the routing of the cable 160 through one or more pulleys from an elevated location and preventing the cable and/or the load interconnected thereto from impeding with or colliding with portions of the rack 200.

One or more embodiments of the present disclosure include an extension arm 202 which comprises an assembly of one or more pulleys 246 wherein the extension arm is interconnectable to the rack. An exploded view of the extension arm is shown for instance in FIG. 12-FIG. 13 to demonstrate an exemplary construction of an extension arm and at least one method in which the extension arm 202 is interconnected to a structure such as a rack 200. The embodiments shown comprise a fitness cable tensioning apparatus 100 interconnected to a load pin 210 (see FIG. 18) wherein the load pin comprises a second connector portion 300. As shown, the second connector portion comprises a male buckle connector which is adapted to interconnect to the female buckle connector (see FIG. 5 for instance) shown of one or more embodiments. The system as shown further comprises an extension arm wherethrough the cable 160 of the fitness cable tensioning apparatus is routed.

Figure 11:
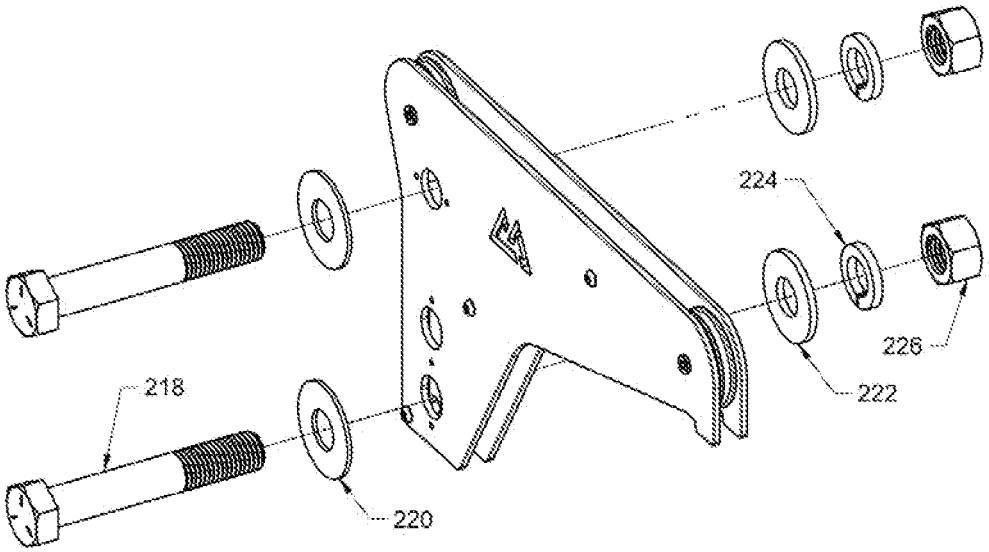
Figure 12:
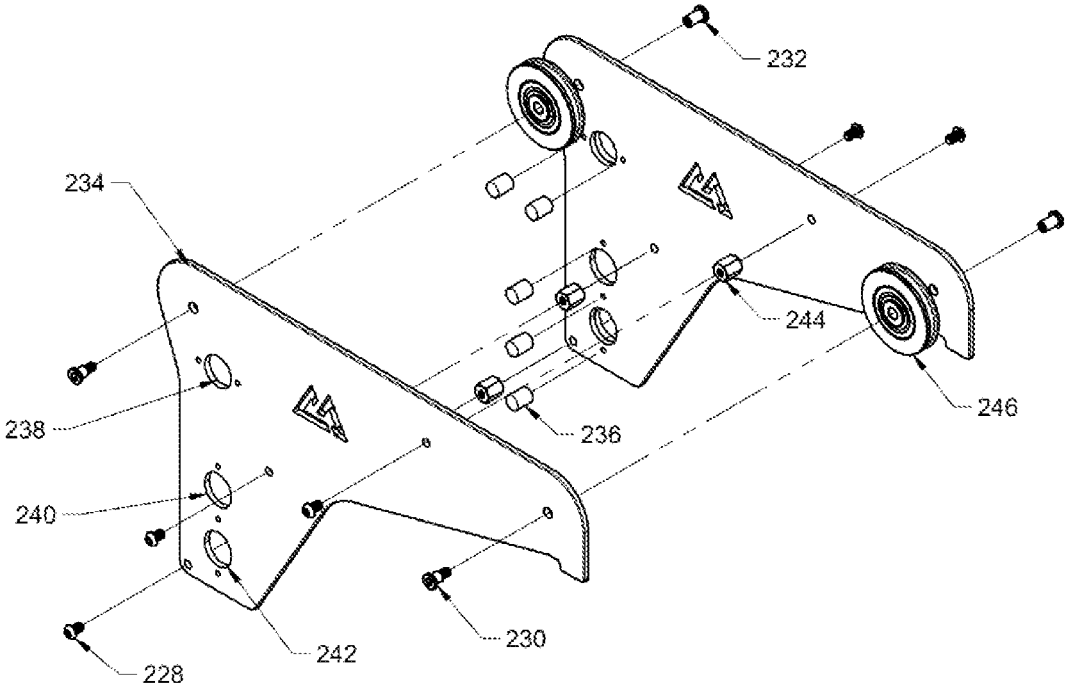
Figure 13:
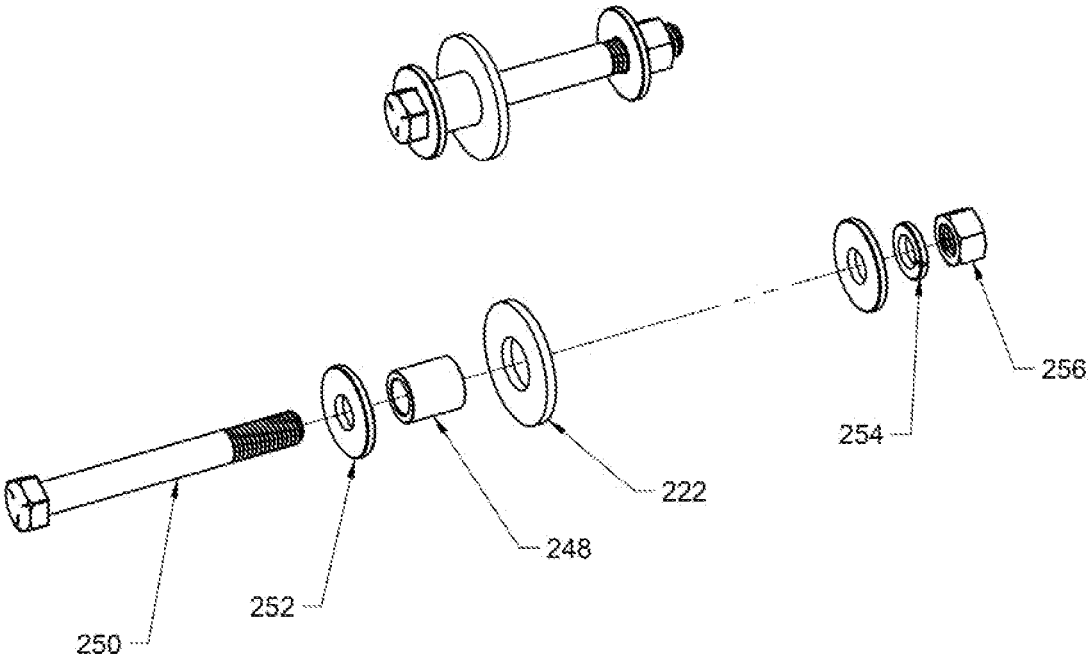

In one or more embodiments, as shown in FIG. 11-FIG. 13 for instance, the extension arm 202 comprises two plates 234 that sandwich the pulleys 246 axially, male sex bolts 230 and female sex bolts 232 to support the pulleys radially, and female hex standoffs 244 and screws 228 to tie the assembly together. The plates 234 further comprise mounting holes to secure the extension arm to a rack 200. In one or more embodiments, the top hole 238 is round and the bottom two holes 240 and 242 are slots to allow for use on metric and inch racks, but are not limited thereto. In one or more embodiments the extension arm further comprises struts 236 configured to add structure to the plates around the mounting holes to prevent compression of the plates toward each other which would result in interference (e.g. binding) with the pulleys 246. In one or more embodiments, extension arm 202 is designed in a symmetrical manner so that the assembly can be flipped 180 degrees about a vertical axis and mounted on the right or left side of a rack post, and further can be mounted to any of the faces of the post 216 depending upon user preference. In one or more embodiments, the assembly is configured to be compatible with racks using 1-inch hardware or ⅝-inch hardware. FIG. 11 shows 1-inch hardware used to mount the extension arm to a 1-inch hardware rack comprising: a 1-inch hex bolt 218, a 1-inch washer 220, a plastic spacer 222, a 1-inch split washer 224, and a 1-inch nut 226. FIG. 13 shows the hardware used to mount to a ⅝-inch hardware rack comprising: a ⅝-inch hex bolt 250, a ⅝-inch washer 252, a plastic spacer 222, a ⅝-inch split washer 254, a ⅝-inch nut 256, and a 1-inch to ⅝-inch adaptor sleeve 248. In one or more embodiments the cable 160 extends downward from an extension arm 202 along a post 216 of the rack and to a carriage assembly 204. The carriage assembly 204 comprises one or more pulleys which are configured to guide the cable 160 to allow a user to pull on the second end of the cable (e.g. with a handle 206) in an altered direction. For instance, as shown in FIG. 9-FIG. 10, the portion of the cable between the extension arm 202 and the carriage 204 is shown in a vertical orientation. The carriage assembly allows a user to pull the cable horizontally outward, diagonally upward, diagonally downward and in a variety of lateral directions from the carriage radially outward from the post 216 which the carriage is mounted.

Figure 14:
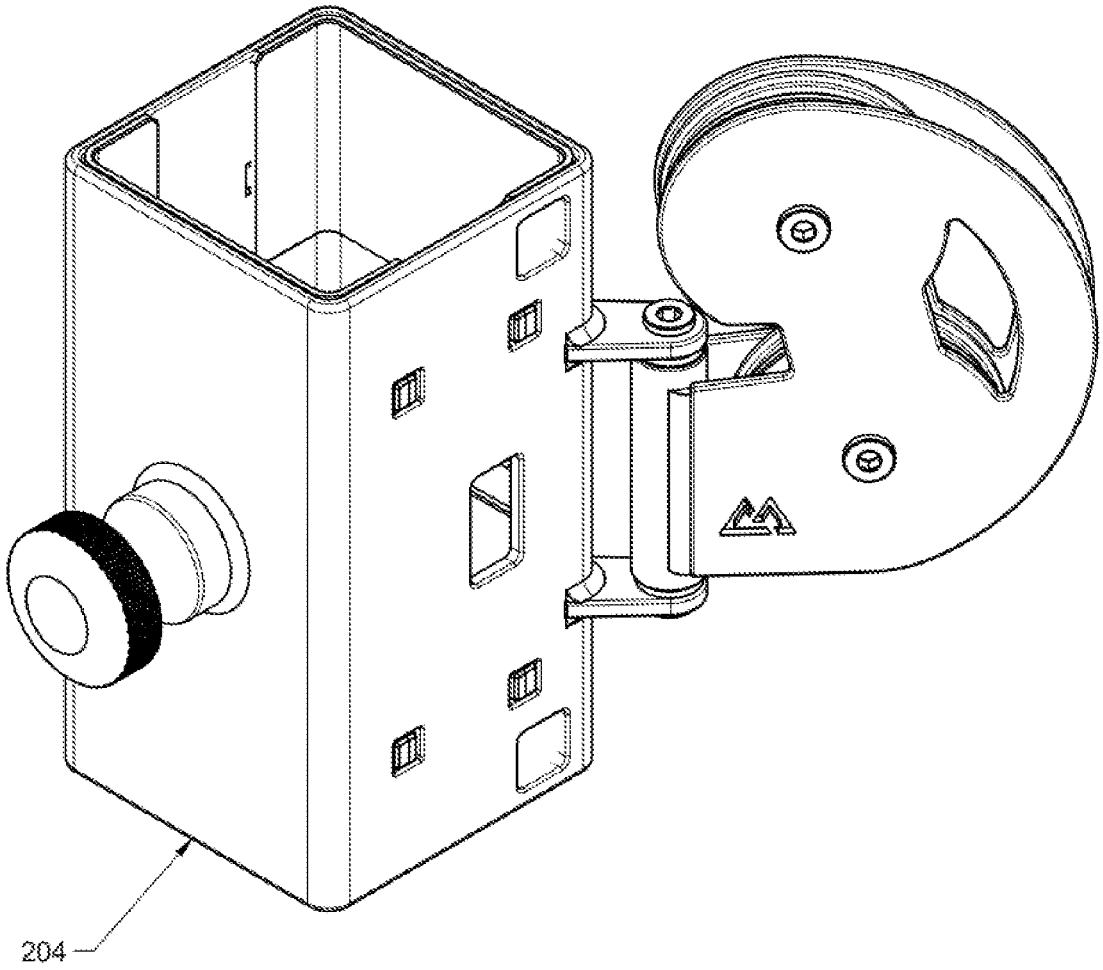
Figure 15:
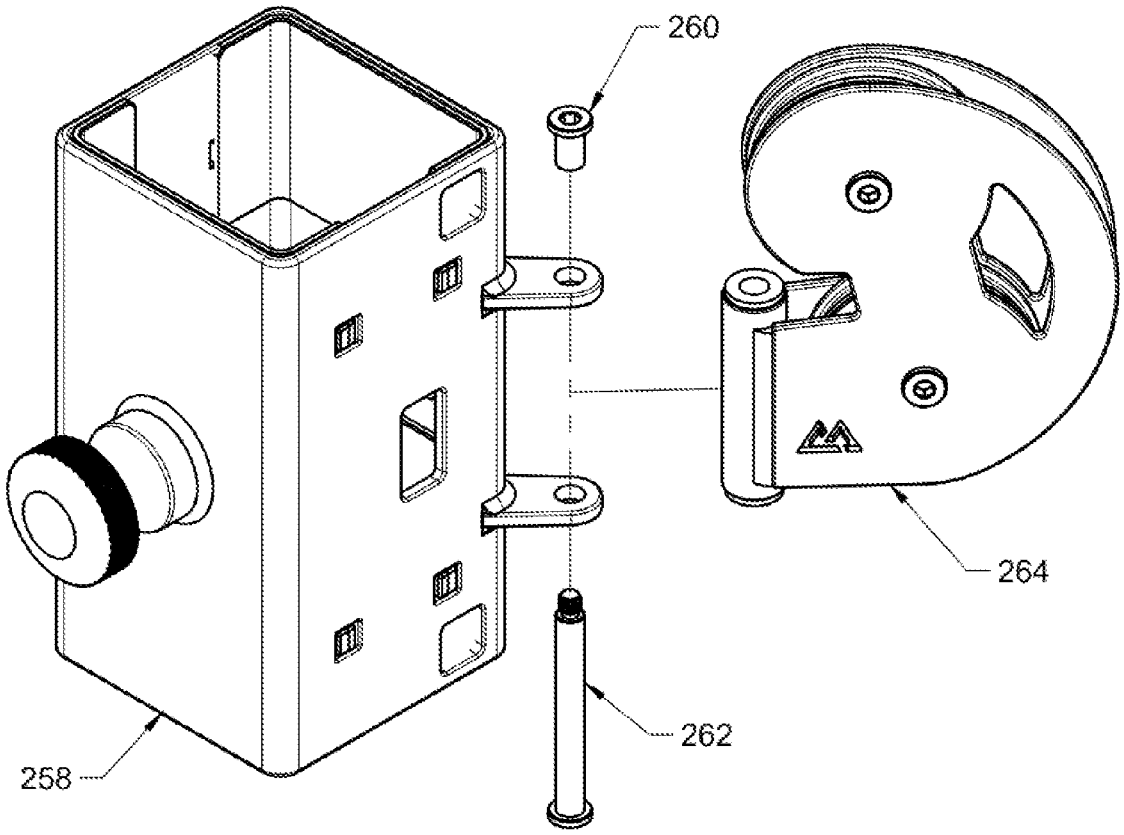

In one or more embodiments, as shown in FIG. 14-FIG. 15 for instance, a carriage assembly 204 of one or more embodiments comprises two sub-assemblies, the rack mount assembly 258 and the swivel assembly 264. The two assemblies are coupled with a pivot joint via a male and female sex bolt pair 262 and 260. The carriage assembly is designed in a way that the rack mount is inverted for use on either right or left rack side mountings in mirrored mounting configurations for instance.

Figure 16:
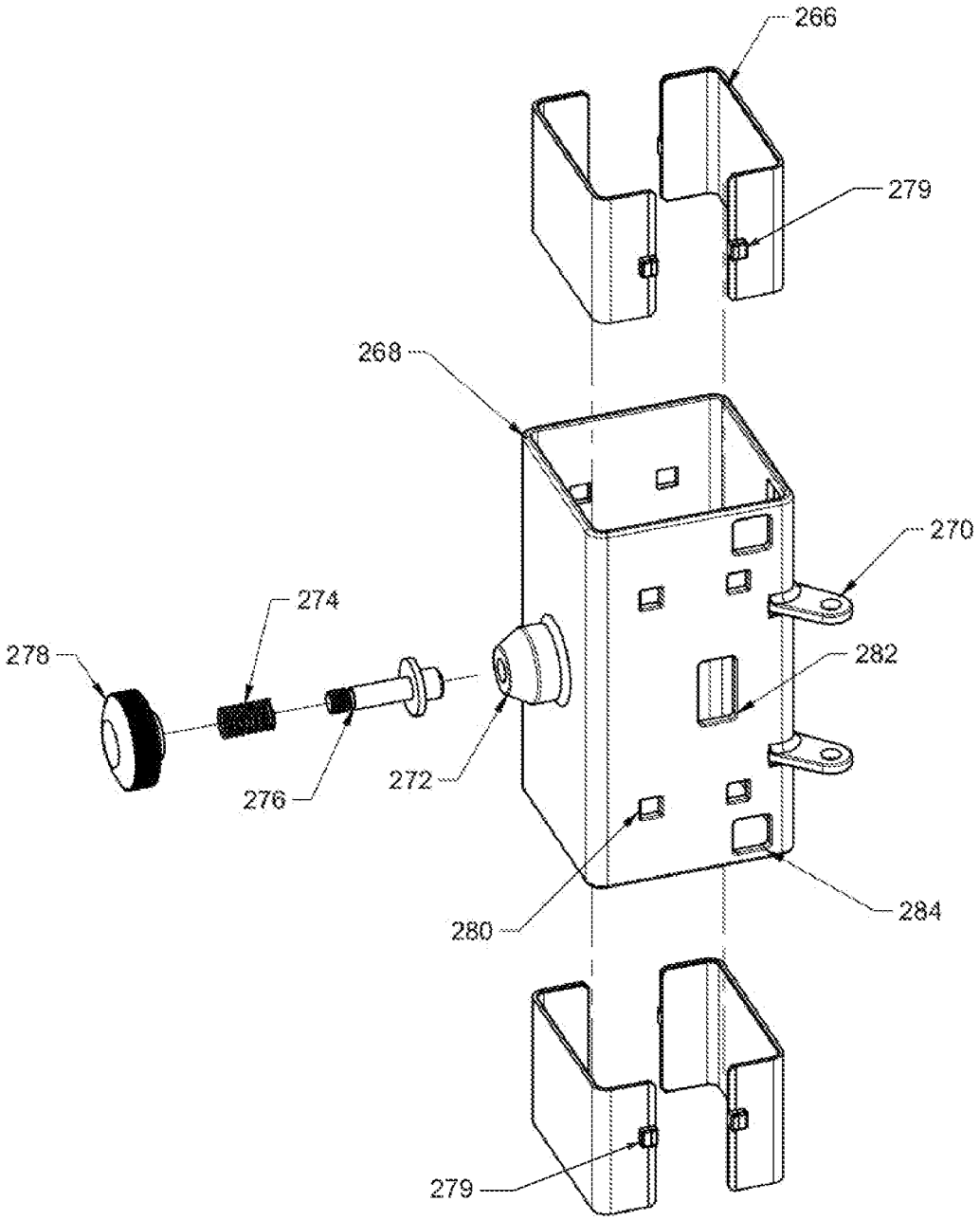

Now referring to FIG. 16, one or more embodiments of a rack mount assembly comprises: a metal tube 268 with two arms 270 welded on and a pop pin housing 272 welded on, plastic linear bushings 266 that index into the metal tube 268, a pop pin shaft 276, a pop pin spring 274, and a pop pin handle 278. While the tube 268 of one or more embodiments as illustrated shows a unitary form, in one or more embodiments the metal tube 268 comprises two or more pieces configured to interconnect to form the metal tube 268. The linear bushings 266 are configured to index into the metal tube to prevent damage to the rack when the carriage assembly 204 is slidably adjusted along the length of a rack post 216, and further acts to eliminate gaps between the carriage assembly 204 and the post 216 which would otherwise result in rattling. The metal tube is optionally constructed from steel and cut with a 3D tube laser. The tube optionally includes cutouts 282 and 284 to allow the sex bolt heads to sit into the cutouts when the swivel assembly is moved to end range. These cutouts allow for 270 degrees of motion. Furthermore, the tube optionally includes cutouts 280 for tabs 279 on the linear bushings to index into. The arms are optionally mild steel and cut with a 2D laser. The pop pin housing is optionally mild steel and is optionally turned (e.g. on a lathe). The aforementioned welded assembly can be powder coated. The pop pin shaft is optionally a turned zinc plated steel. The pop pin handle is optionally a turned anodized aluminum. The linear bushings are optionally constructed with injection molded plastic.

Figure 17:
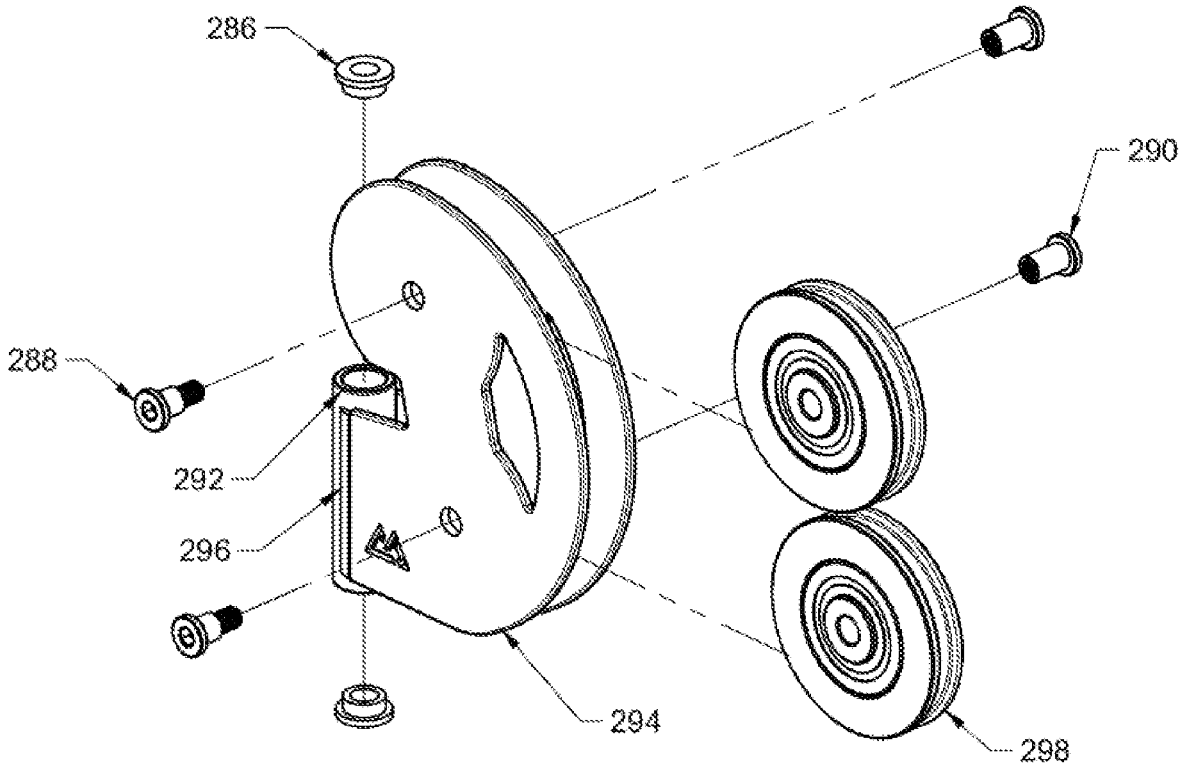

FIG. 17 illustrates one or more embodiments of the present disclosure comprising a swivel assembly 264. This embodiment comprises: a three-part welded assembly made up of two identical plates 294 and a round tube 292, two pulley assemblies 298, two sets of male and female sex bolts 288, 290, and two bushings 286. The assembly is optionally welded at junction 296 and is optionally constructed from steel and powder coated after welding. The pulleys of one or more embodiments are optionally plastic, aluminum, or stainless steel with bearings, but not limited thereto. Furthermore, the bushings 286 one or more embodiments are sintered bronze.

Figure 18:
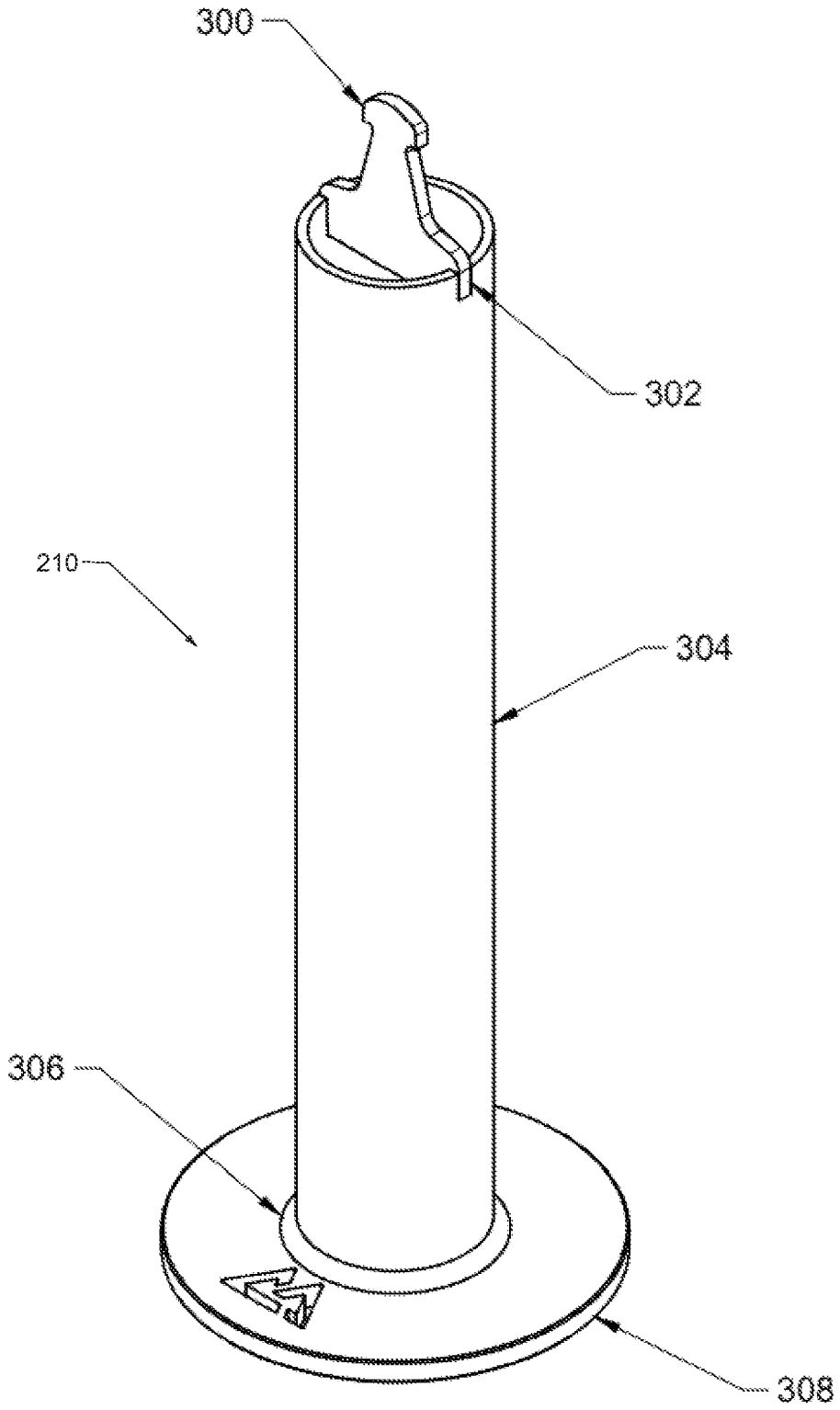

One or more embodiments of the present disclosure, shown in FIG. 18 for instance, comprises a load pin 210. The load pin 210 as shown is configured to have weights (e.g. weight plates with a center hole) loaded onto the shaft 304, a bottom portion of the shaft comprises a base plate 308. The base plate is configured to constrain any weights loaded onto the shaft 304 and prevent the weights from falling when the load pin 210 is lifted. The top portion of the load pin further comprises a second connector portion 300. As shown, the second connector portion comprises a male buckle portion which is configured to interconnect with a female buckle portion 178 as shown in FIG. 5 for instance. In one or more embodiments the load pin comprises a base plate 308, a shaft 304 (e.g. a portion of a pipe) , and a male quick release buckle 300 wherein the forementioned parts are welded together as shown (302, 306). These load pin 210 of one or more embodiments are constructed of steel and optionally powder coated after construction. The male quick release buckle is a specific geometry designed to mate with the female quick release buckle in the bottom of the cable tensioning device. This buckle allows for quick and easy coupling between the load pin and the cable tensioning apparatus.

Figure 19:
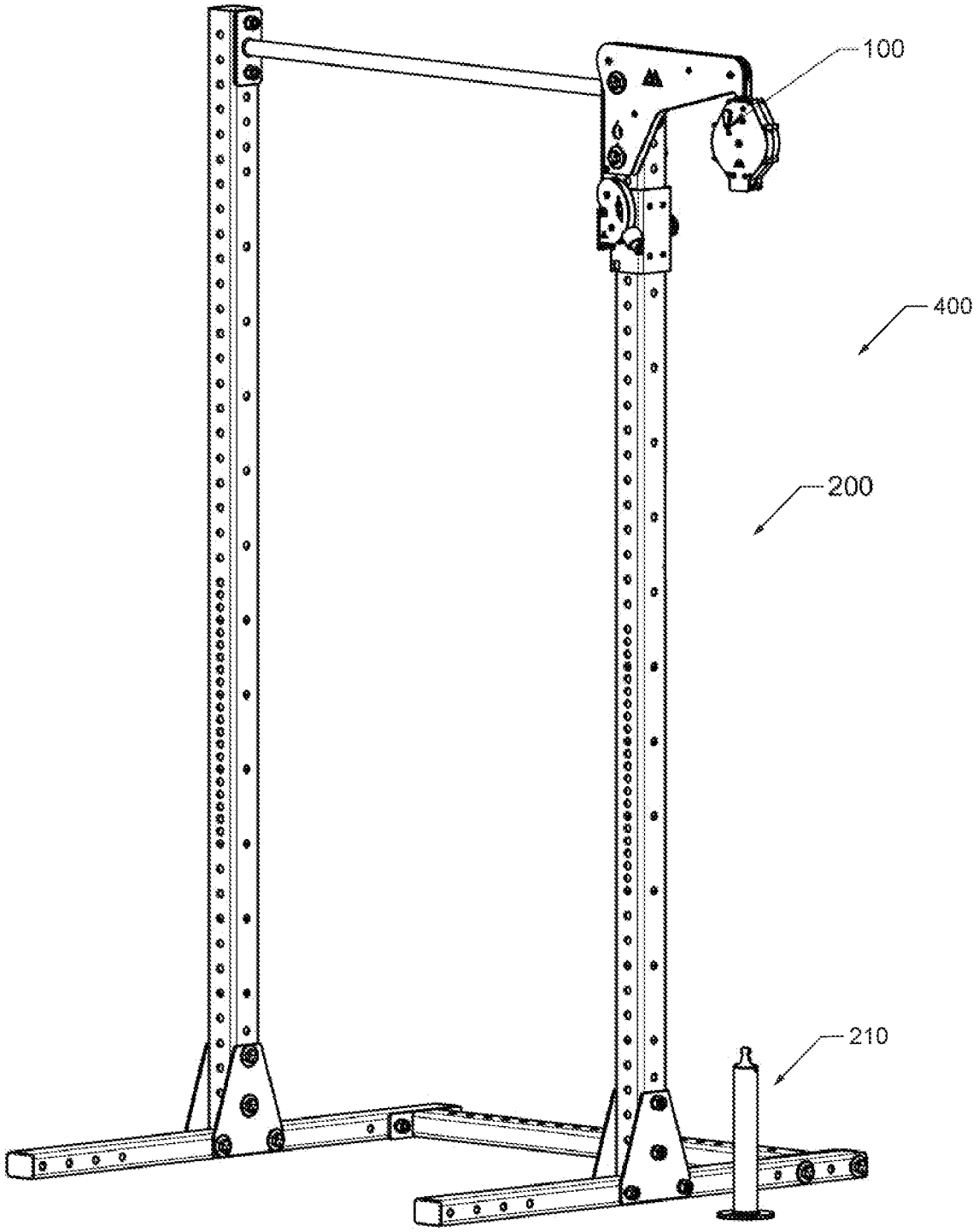
Figure 20:
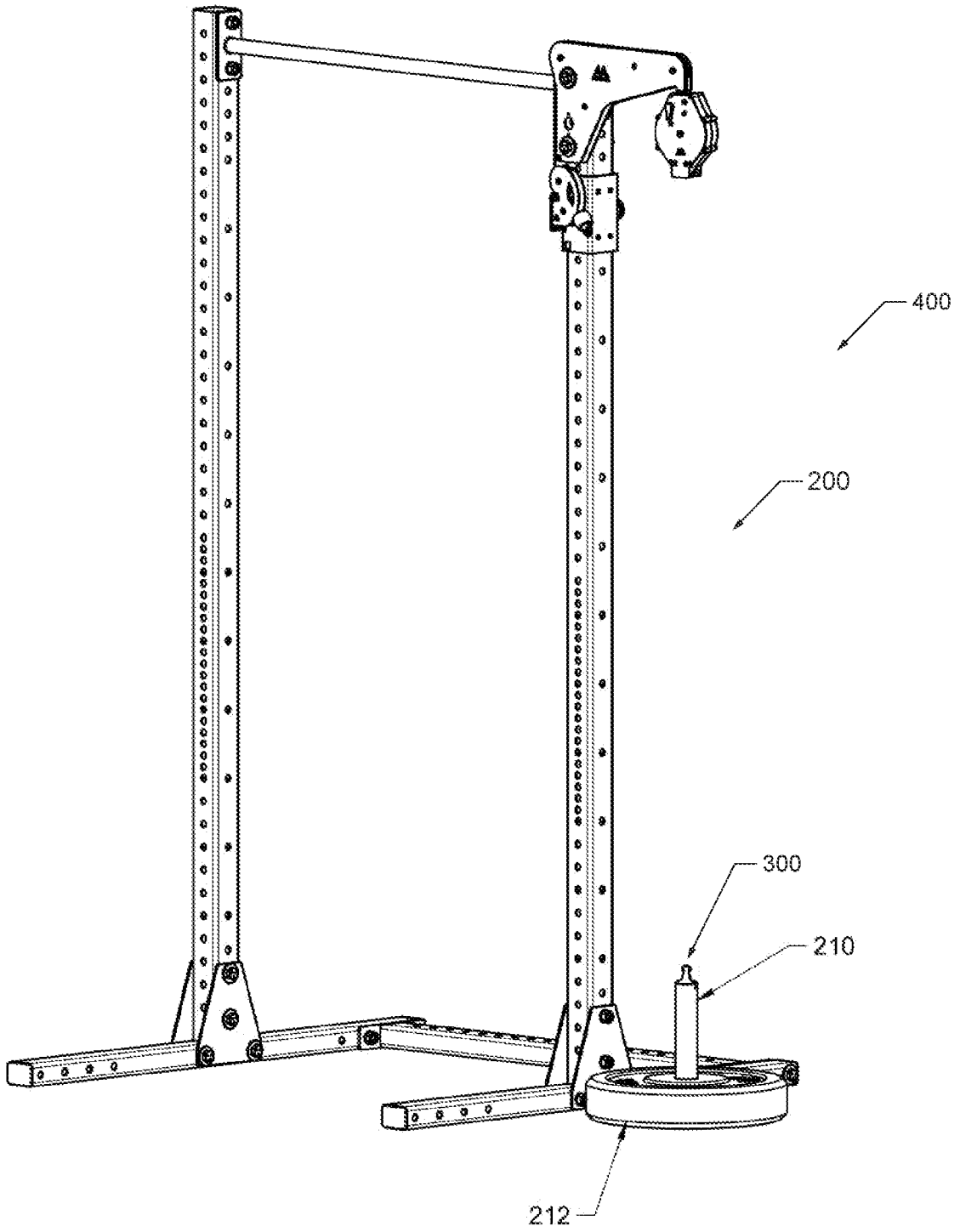
Figure 21:
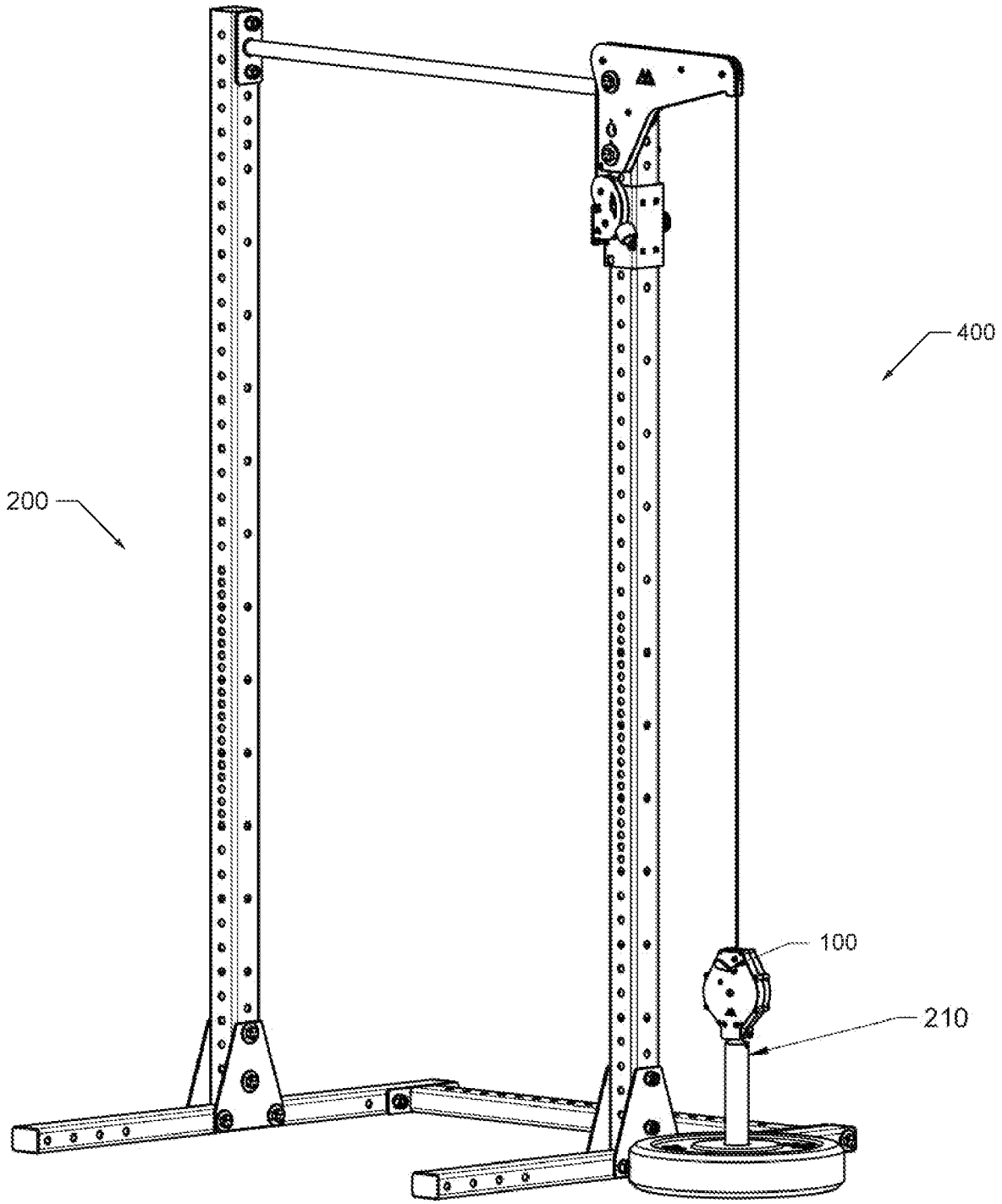
Figure 22:
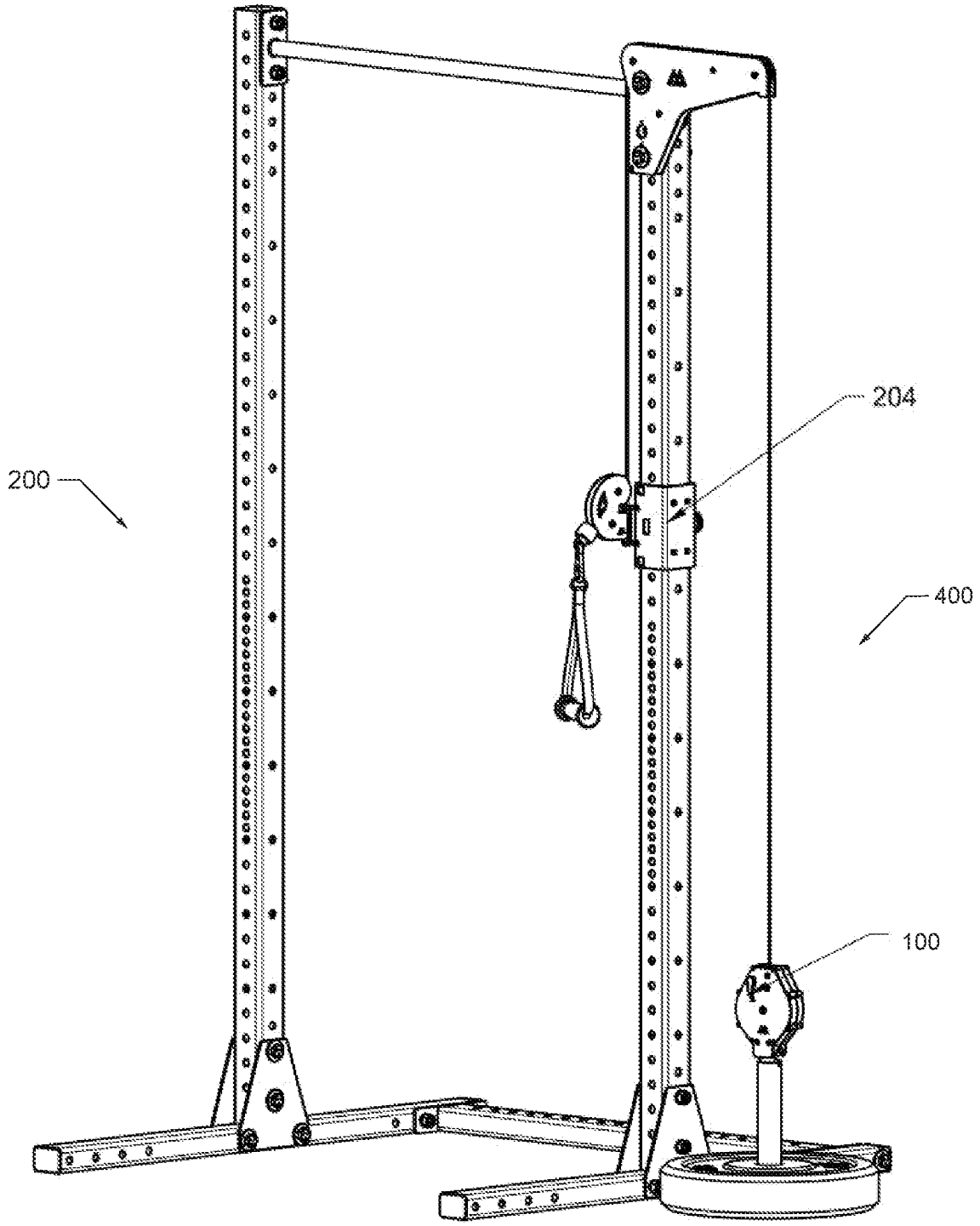
Figure 23:
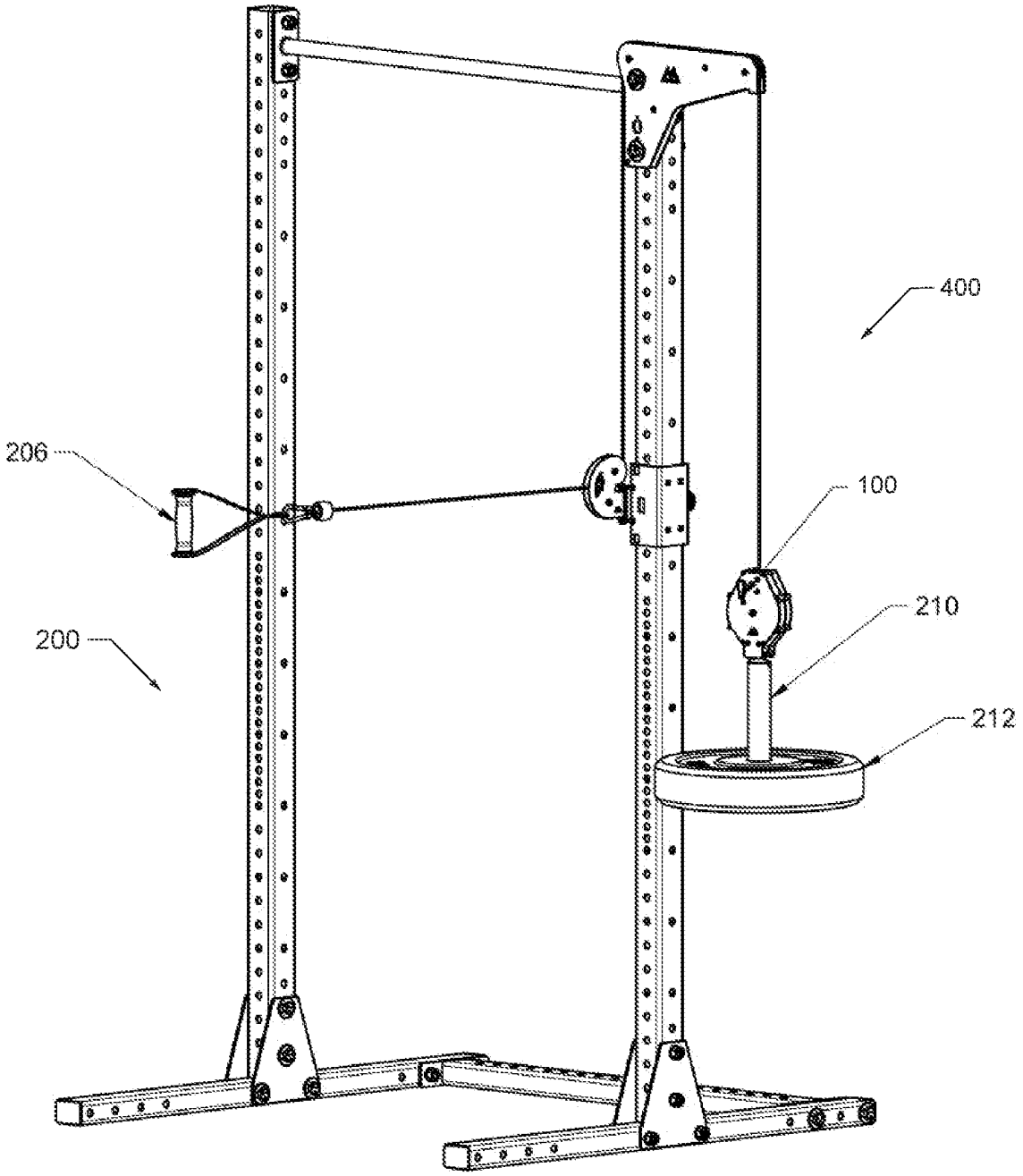

Referencing FIG. 19-FIG. 23, one or more embodiments are illustrated showing potential steps in configuring a fitness cable tensioning system 400 using a fitness cable tensioning apparatus 100 in conjunction with a rack system 200. FIG. 19 illustrates a potential storage wherein the fitness cable tensioning apparatus 100 is in a locked configuration and raised out of the way of the commonly used areas of the rack 200. The action of the power spring as previously described acts to retract the cable within the fitness cable tensioning apparatus 100 to store the cable 160 on the spool within the fitness cable tensioning apparatus 100. FIG. 20 illustrates a load pin 210 in place with a desired number of weight plates 212 loaded onto the load pin. The user then places the fitness cable tensioning apparatus in an unlocked configuration allowing for the extension of the relative length of the cable and allowing the extension of the fitness cable tensioning apparatus 100 toward the load pin 210 as shown in FIG. 21. While the fitness cable tensioning apparatus 100 is still configured in an unlocked configuration, the user optionally adjusts the height of the carriage 204, noting the location in FIG. 22 in comparison to the location of the carriage 204 in FIG. 21. After the user has configured the system in a manner which is suitable to user preference and/or requirements as associated with a particular fitness movement, the user configures the fitness cable tensioning apparatus 100 to a locked configuration wherein the fitness cable tensioning apparatus is configured to allow the cable to be retracted into the fitness cable tensioning apparatus and onto the spool, but does not allow the cable to be extended out of the fitness cable tensioning apparatus 100. Accordingly, when a user applies a force to the handle 206 (e.g. pulling the handle away from the carriage 204, pushing the handle away from the carriage) the force applied to the handle serves to lift the fitness cable tensioning apparatus 100, the load pin 210, and the weight attached thereto. If the user, for instance, preferred to raise the carriage from the position shown in FIG. 22-FIG. 23, to a higher position the user is able to do so without configuring the fitness cable tensioning apparatus to an unlocked configuration as such an action would result in a shorter effective cable length and the fitness cable tensioning apparatus would retract the cable as the carriage is raised. However, if the user for instance, preferred to lower the carriage from the position shown in FIG. 22-FIG. 23, the user would need to configure the fitness cable tensioning apparatus 100 in an unlocked configuration prior to making the adjustment as the adjustment requires a longer effective cable length and would require extending the cable out further from the fitness cable tensioning apparatus.

Figure 24A:
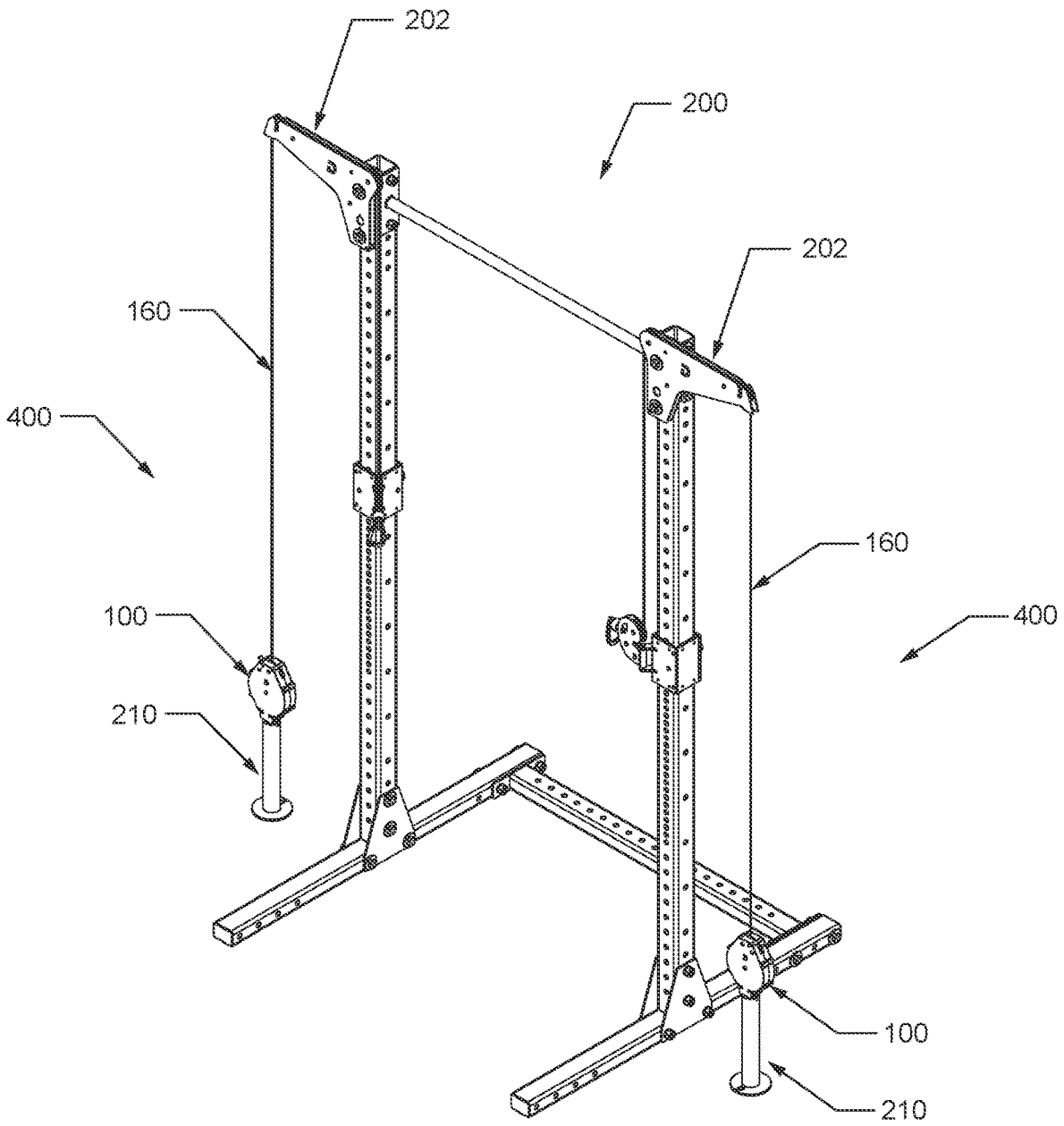
FIG. 24A—A first perspective view of one or more embodiments of a cable tensioning system interconnected to an exemplary rack having two posts, the one or more embodiments of the cable tensioning system in a first configuration FIG. 24B—A second perspective view of the cable tensioning system shown in FIG. 24A FIG. 24C—A side detail view of an extension arm of the one or more embodiments shown in FIG. 24A-FIG. 24B FIG. 24D—A side exploded view of the extension arm of the one or more embodiments illustrated in FIG. 24C FIG. 25A—A first perspective view of one or more embodiments of a cable tensioning system interconnected to an exemplary rack having four posts, the one or more embodiments of the cable tensioning system in a second configuration FIG. 25B—A second perspective view of the cable tensioning system shown in FIG. 25A FIG. 25C—A first perspective view of one or more embodiments of a cable tensioning system interconnected to an exemplary rack having four posts, the one or more embodiments of the cable tensioning system in a third configuration FIG. 25D—A second perspective view of the cable tensioning system shown in FIG. 25C FIG. 26A—A perspective view of one or more embodiments of a cable tensioning apparatus interconnected to a trolley of one or more embodiments of the present disclosure FIG. 26B—A side view of the cable tensioning apparatus interconnected to a trolley shown in FIG. 26A FIG. 26C—A first exploded side view of the cable tensioning apparatus and trolley shown in FIG. 26A-FIG. 26B, demonstrating the removal of a first load receiving element and the cable tensioning apparatus FIG. 26D—A second exploded side view of the cable tensioning apparatus and trolley shown in FIG. 26A-FIG. 26C, demonstrating the removal of a first load receiving element and the cable tensioning apparatus FIG. 26E—An exploded perspective view of the cable tensioning apparatus and trolley shown in FIG. 26A-FIG. 26D, demonstrating the removal of a first load receiving element and the cable tensioning apparatus from the trolley FIG. 26F—An exploded front view of the cable tensioning apparatus and trolley of one or more embodiments, demonstrating the removal of the cable tensioning apparatus from the trolley FIG. 26G—An exploded top view of the cable tensioning apparatus and trolley shown in FIG. 26F FIG. 26H—An exploded perspective view of the cable tensioning apparatus and trolley shown in FIG. 26F-FIG. 26G FIG. 26I—A perspective view of a trolley of one or more embodiments of the present disclosure FIG. 26J—An exploded perspective view of a trolley of one or more embodiments of the present disclosure FIG. 27A—A perspective view of one or more cam elements of one or more embodiments of the present disclosure FIG. 27B—A side view of the one or more cam elements shown in FIG. 27A FIG. 27C—A cross sectional view of the one or more cam elements shown in FIG. 27B FIG. 28A—A side view of a fitness cable tensioning apparatus of one or more embodiments of the present disclosure FIG. 28B—A first perspective view of a fitness cable tensioning apparatus of one or more embodiments of the present disclosure FIG. 28C—A second perspective view of a fitness cable tensioning apparatus of one or more embodiments of the present disclosure FIG. 28D—A transparent side view of a fitness cable tensioning apparatus of one or more embodiments of the present disclosure in an unlocked configuration FIG. 28E—A transparent side view of a fitness cable tensioning apparatus of one or more embodiments of the present disclosure in a locked configuration FIG. 28F—An exploded perspective view of a fitness cable tensioning apparatus of one or more embodiments FIG. 29—A perspective view of a pawl one or more embodiments of the present disclosure FIG. 30A—A front view of one or more embodiments comprising a female buckle connector FIG. 30B—A side view of one or more embodiments comprising a female buckle connector FIG. 30C—A cross-sectional view of the female buckle connector shown in FIG. 30B
Figure 24B:
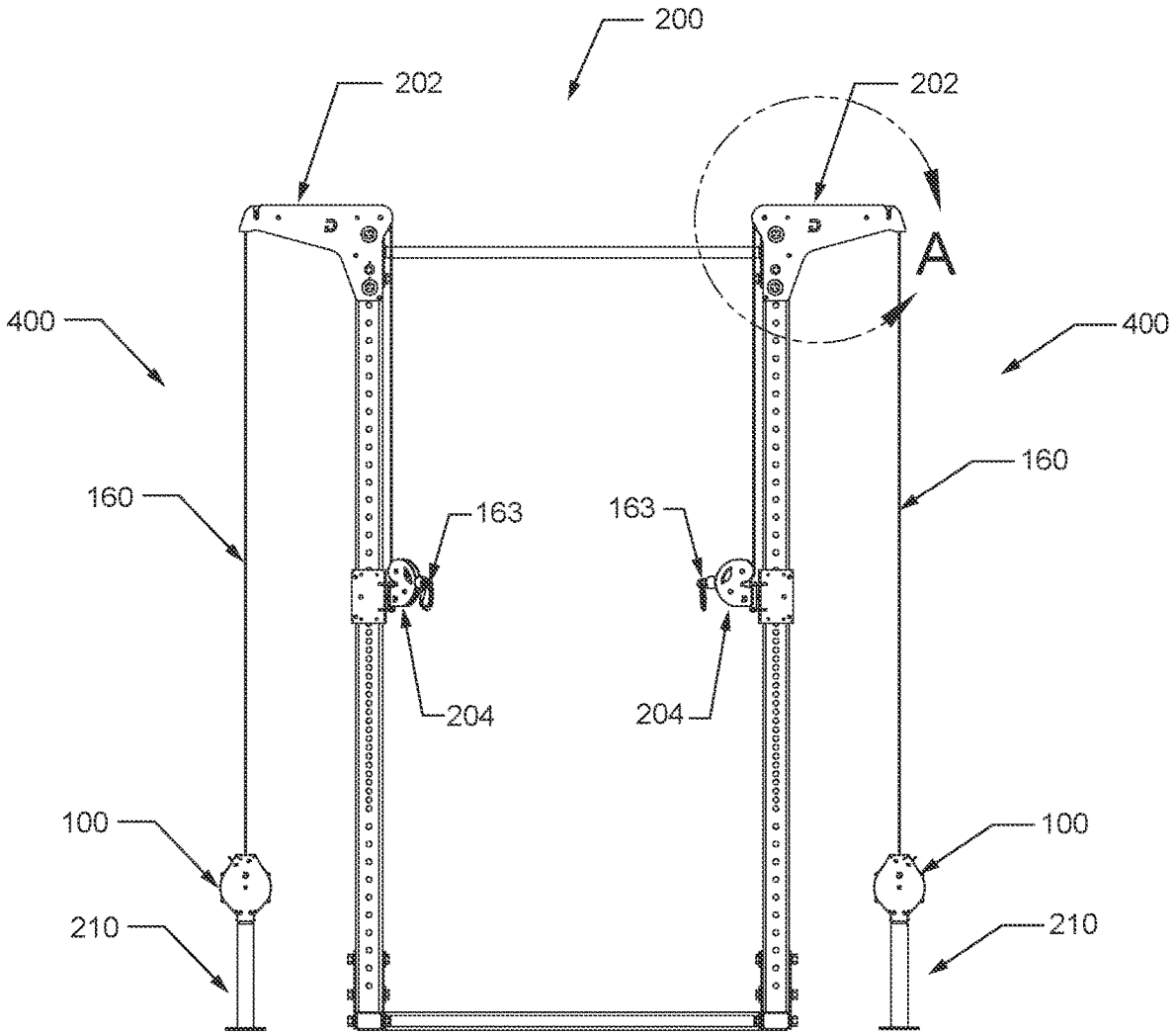

In one or more embodiments as shown in FIG. 24A-FIG. 24B, it may be desired to use multiple systems which are configured similarly (e.g. bilateral workouts for arms) wherein a first system 400 incorporating a fitness cable tensioning apparatus 100 and load pin 210 is assembled on a first side of the rack, and a second system, similarly configured, is assembled on the second side of the rack. The systems as shown each comprise an extension arm assembly 202 wherethrough the cable 160 of the fitness cable tensioning apparatus 100 extends through and wherein a second end 163 of the cable terminates at a carriage assembly 204.

Figure 24C:
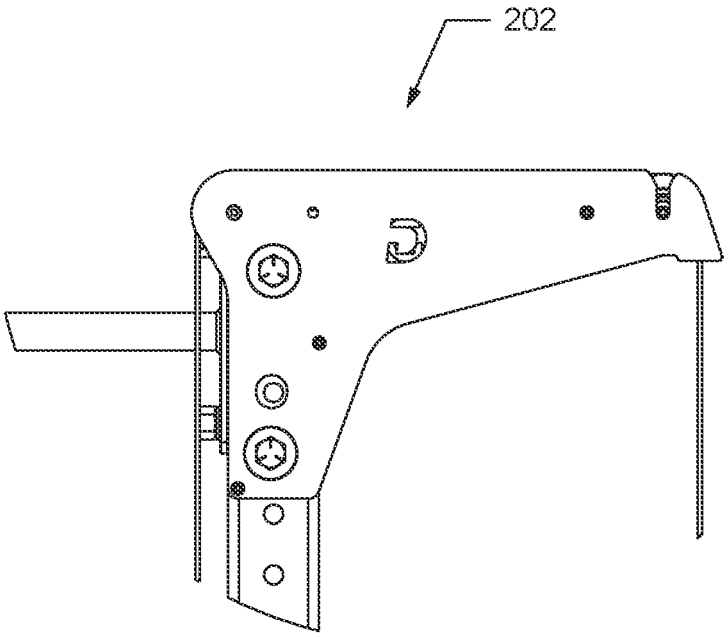
Figure 24D:
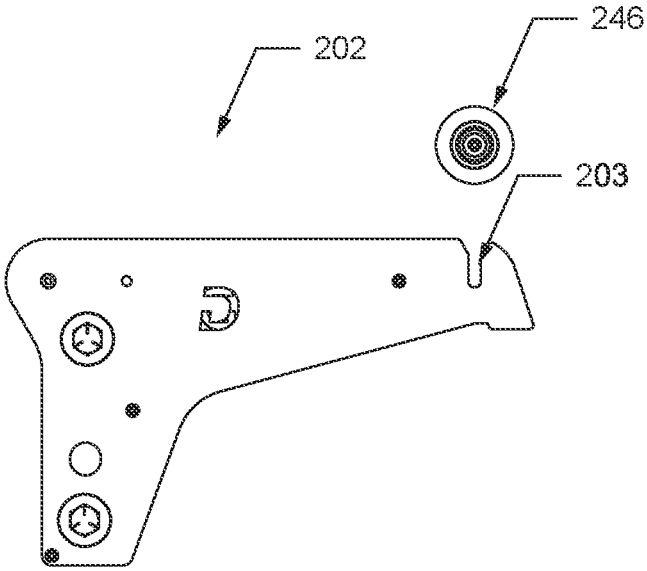

The extension arm 202 as shown in FIG. 24B further comprises a removeable pulley 246, shown for instance in FIG. 24C-FIG. 24D, to further allow the reconfiguration of a system comprising a fitness cable tensioning apparatus 100. As shown, the removeable pulley 246 is configured to index into a slot 203 which has an open aspect, wherein the pulley 246 is slidably removable by lifting the pulley 246 upward. However, alternative strategies for removing a pulley 246 (e.g. removeable pin) are within the spirit and scope of the present disclosure. For instance, further systems shown in FIG. 25A-FIG. 25D further demonstrate exemplary systems 400 comprises a fitness cable tensioning apparatus 100 optionally in conjunction with a rack 200. The removable pulley 246 as shown in FIG. 24A-FIG. 24B allows for multiple routings of the cable 160 in conjunction with a system 400. For instance, in FIG. 24A-FIG. 24B, the cable is routed to allow the use of a load pin 210 to prevent the load pin 210 and weights loaded onto the load pin from impacting the rack 200 and to further prevent the load pin and weights from encumbering other movements which use the rack. In one or more embodiments the removeable pulley 246 allows the rerouting of a cable wherein the cable routes directly downward from the extension arm 202, and through a carriage, prior to routing back upward through the removeable pulley as shown in FIG. 25B thus allows for a use to easily reconfigure such a system 400 from an overhead workout wherein the second end of the cable terminates at the extension arm 202 as shown in FIG. 25B, to a configuration wherein for a lateral workout wherein the second end 163 of the cabler terminates at the carriage 204 as shown in FIG. 25C-FIG. 25D wherein the routing through the upper arm 202 in the embodiments shown in FIG. 25C-FIG. 25D differ from those embodiments shown in FIG. 25A-FIG. 25B. Each of the exemplary embodiments illustrated are optionally configurable to use an accessory such as a load bearing device (e.g. load pin 210, trolley 450), or alternate methods of applying a load for the purposes of a fitness movement. A trolley 450 as referred to herein provides one of many alternatives for providing resistance via a load for a fitness-based exercise using the fitness cable tensioning apparatus 100. One or more embodiments of a trolley 450 are configured for use in conjunction with a post 216 of a rack, but not limited thereto. Furthermore, systems are not limited to embodiments disclosed herein and optionally include a series of pulleys which are attachable via rigid hardware (e.g. bolts), with flexible straps (e.g. polyester webbing), or otherwise.

Figure 25A:
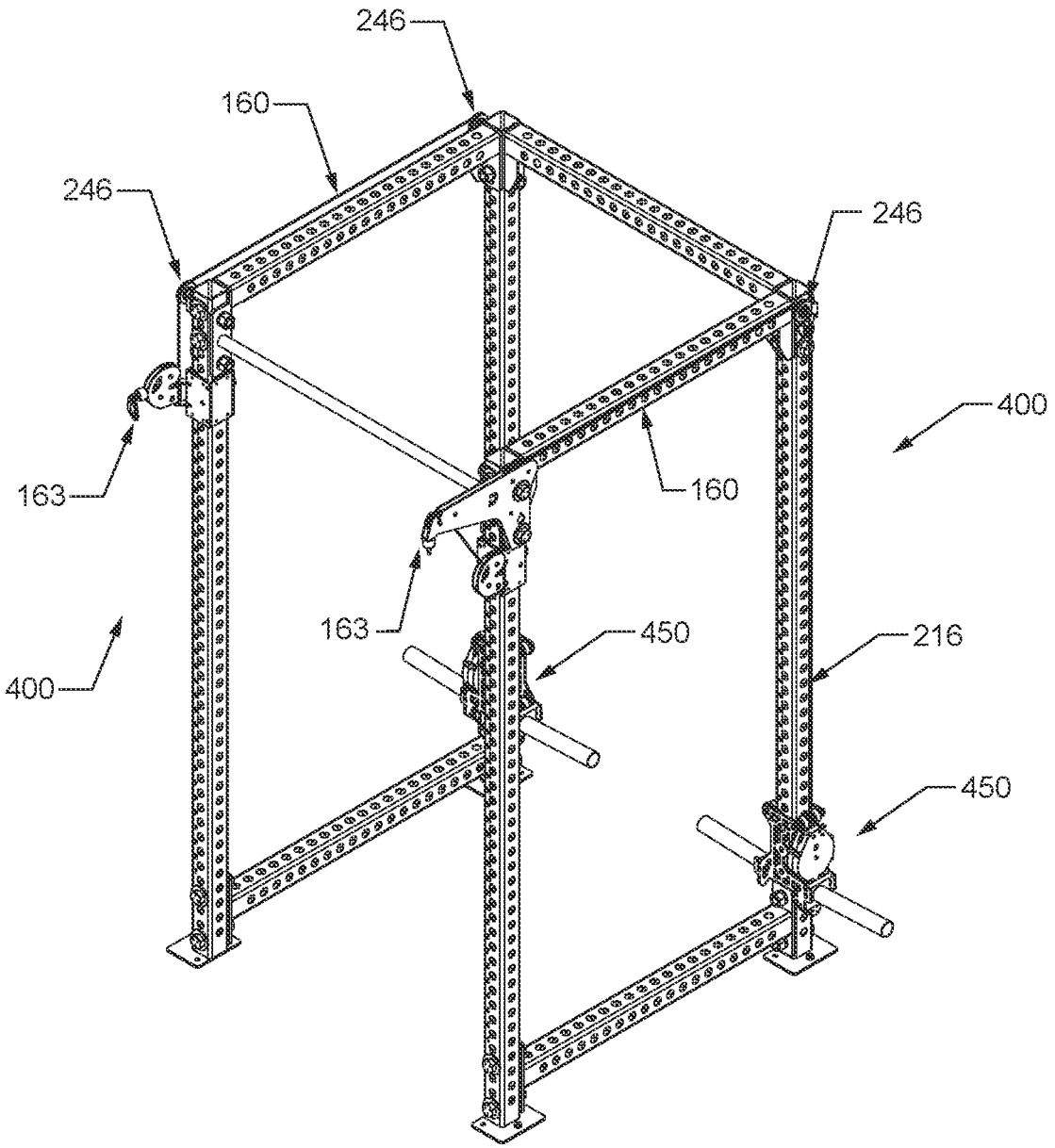
Figure 25B:
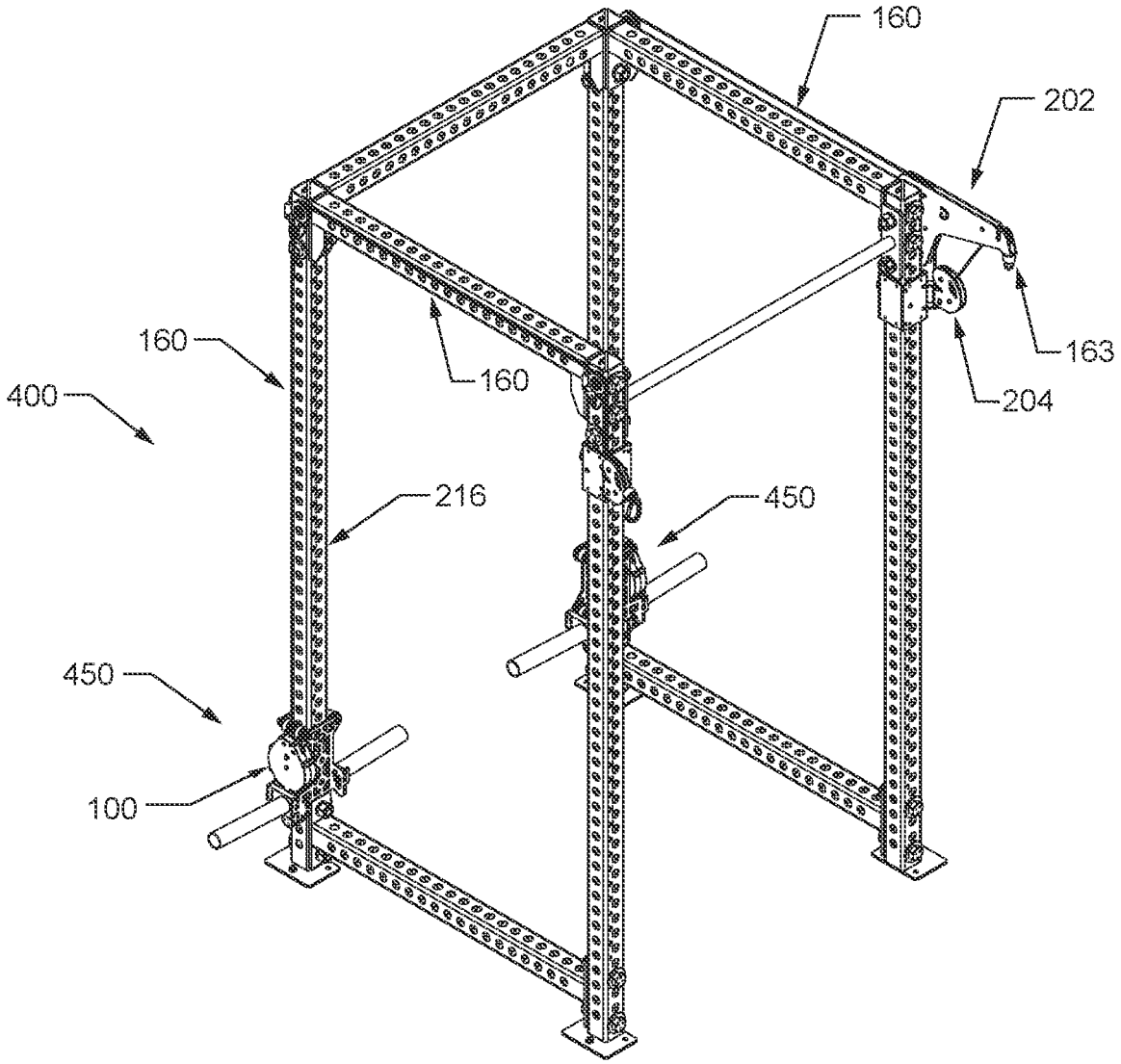
Figure 25C:
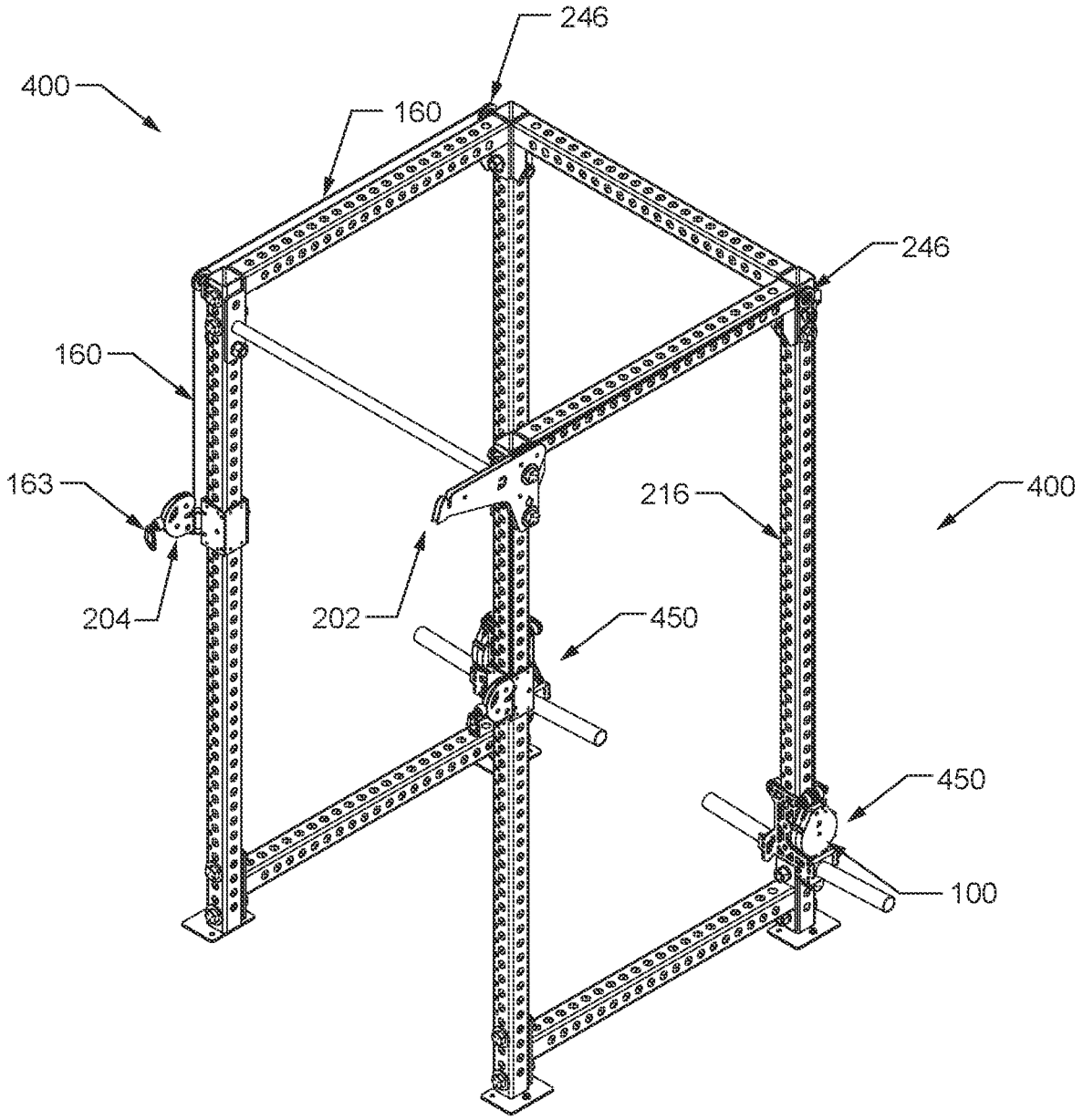
Figure 25D:
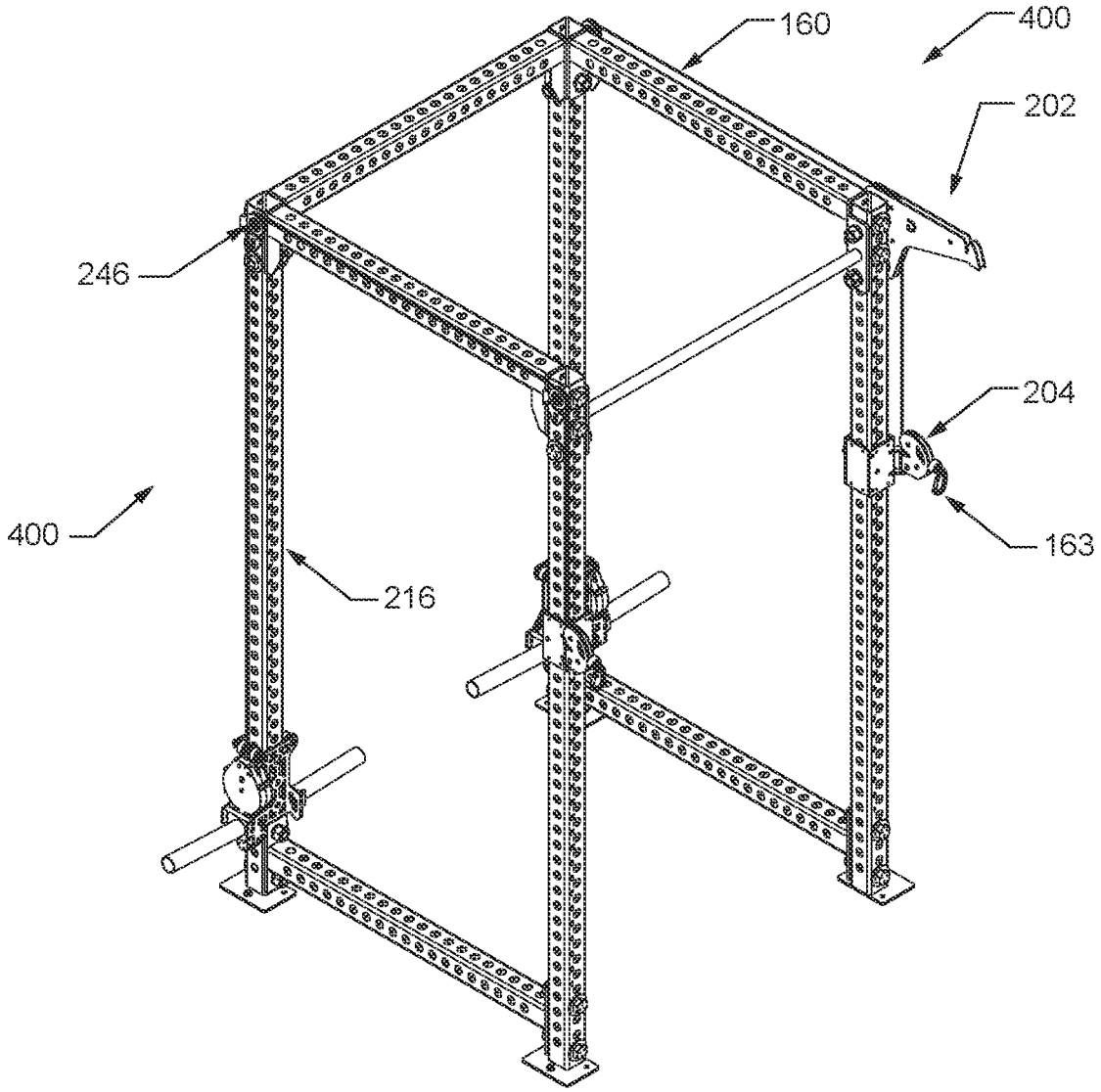

One or more embodiments of the present disclosure, for example as shown in FIG. 25A-FIG. 25D, surround a modular and reconfigurable system 400 for use in conjunction with a fitness cable tensioning apparatus 100 as described herein. FIG. 25A-FIG. 25B illustrate two views of the same system 400 wherein the fitness cable tensioning apparatus 100 is interconnected with a trolley assembly 450, wherein the trolley is configured to ride longitudinally along a post 216 of a rack. The trolley 450 is configured to receive a load (e.g. weights, load bands) to provide resistance for a workout or fitness movement. The fitness cable tensioning apparatus 100 is interconnected to the trolley 450 and the cable 160 extended out from the fitness cable tensioning apparatus 100 to a location wherein the user is able to apply a load to the second end 163 of the cable.

One or more embodiments of a trolley 450 are illustrated in FIG. 26A-FIG. 26J wherein the trolley 450 is configured to interconnect with a fitness cable tensioning apparatus 100 and wherein the trolley is further configured to receive a load and travel longitudinally along a post 216 of a rack (see FIG. 25A-FIG. 25D).

Figure 26A:
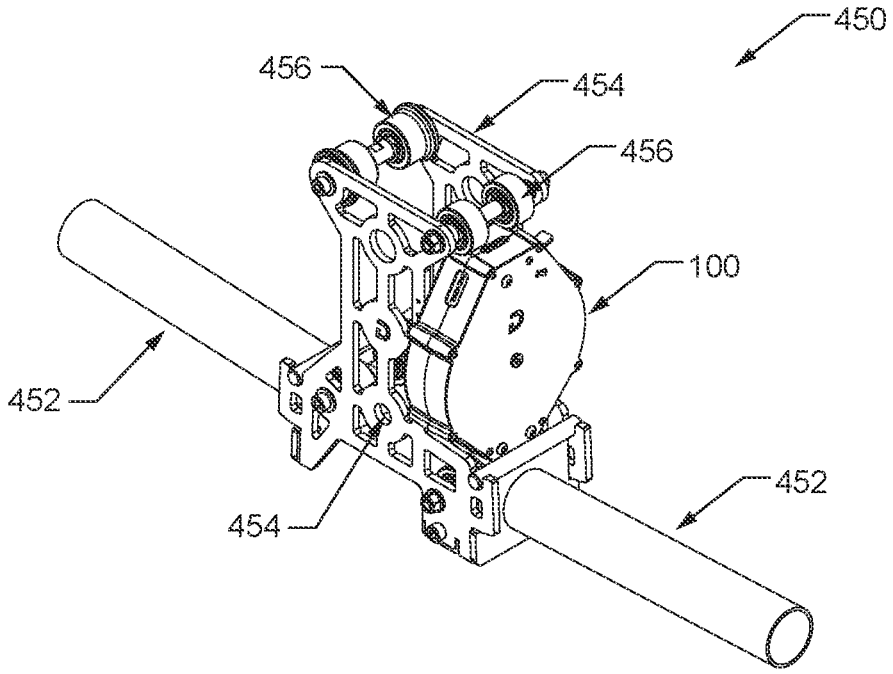
Figure 26B:
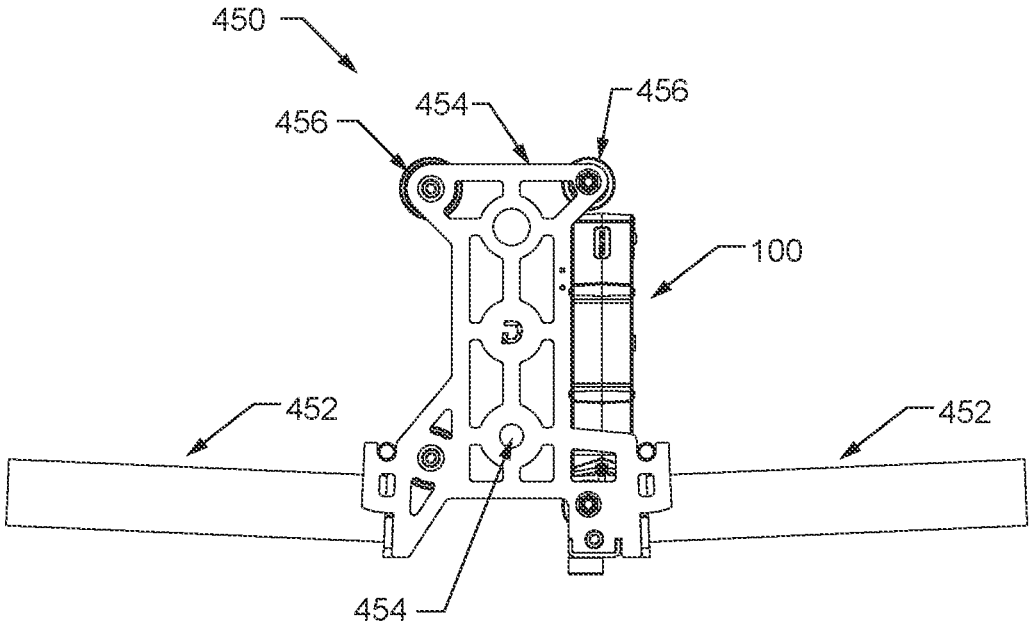

One or more embodiments, as illustrated in FIG. 26A-FIG. 26B for instance, comprise a fitness cable tensioning apparatus 100 interconnected with a trolley wherein the trolley has one or more load receivers (e.g. weight horns 452) for applying a load to the trolley. The weight horns 452 as shown are configured to receive weight plates 212 (see FIG. 20). While embodiments shown demonstrate weight horns 452, alternate embodiments wherein a load is applied to the trolley through the use of load bands, or other method of applying a load for weightlifting or resistance type fitness exercises are within the spirit and scope of the present disclosure. In one or more embodiments the trolley 450 comprises two plates 454 which are offset from each other and interconnected by a series of rollers 456 configured to ride longitudinally along the post of a rack. In one or more embodiments the weight horns 452 and/or the fitness cable tensioning apparatus 100 are removably interconnectable to the trolley in the event the use wishes to disconnect the weight horns 452 or the fitness cable tensioning apparatus 100 for purposes of reconfiguration or storage.

Figure 26C:
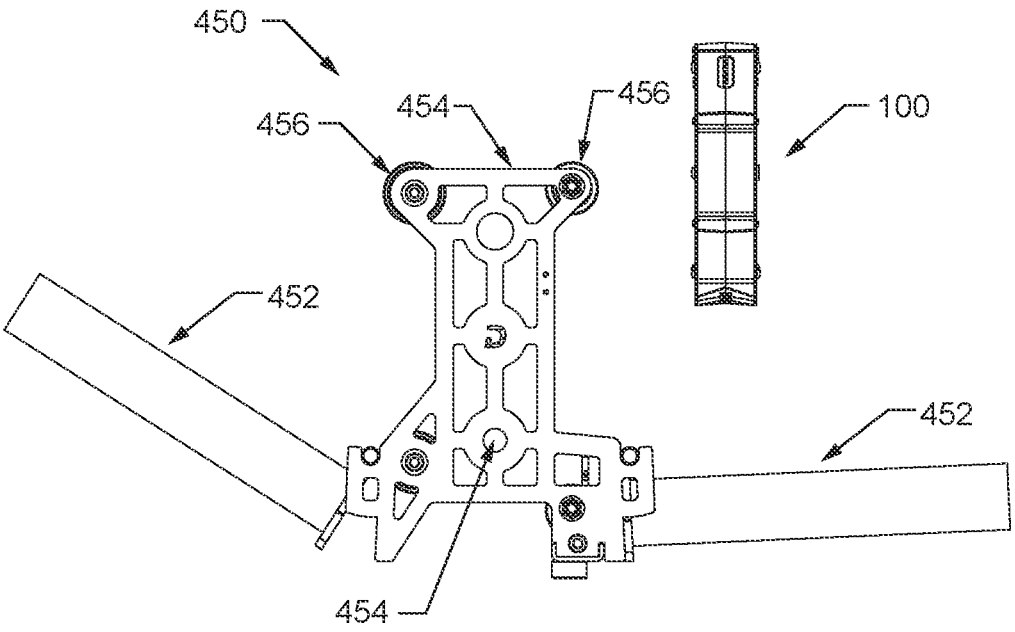
Figure 26D:
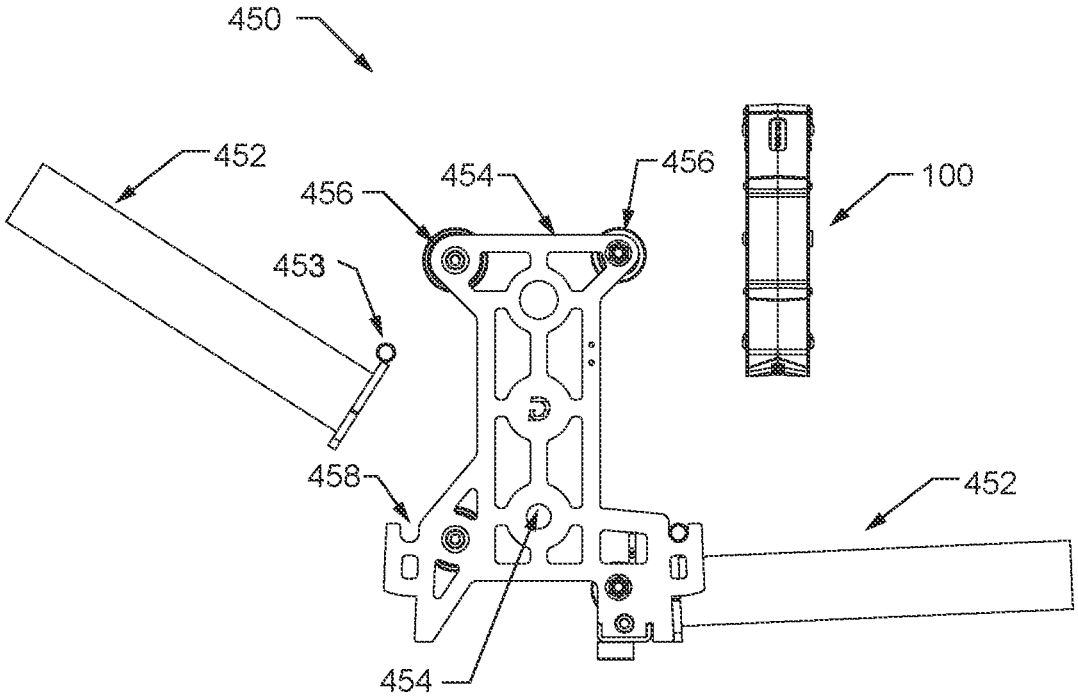
Figure 26E:
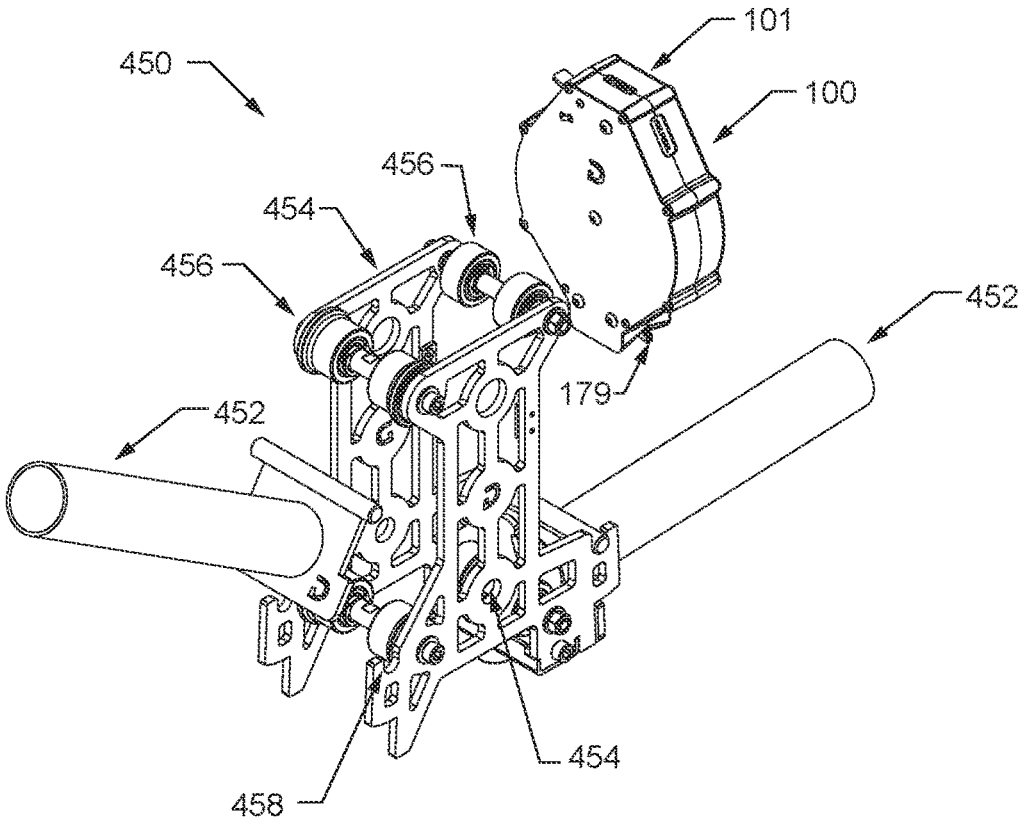
Figure 26F:
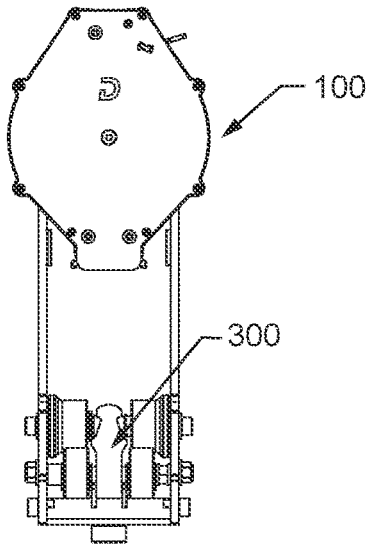
Figure 26G:
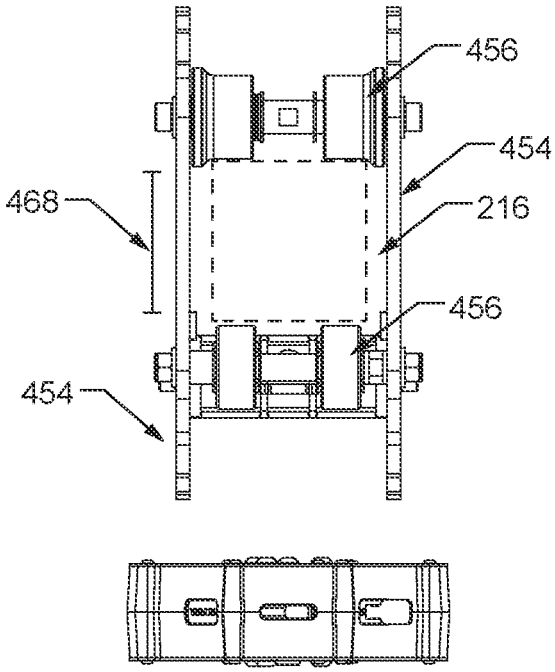
Figure 26H:
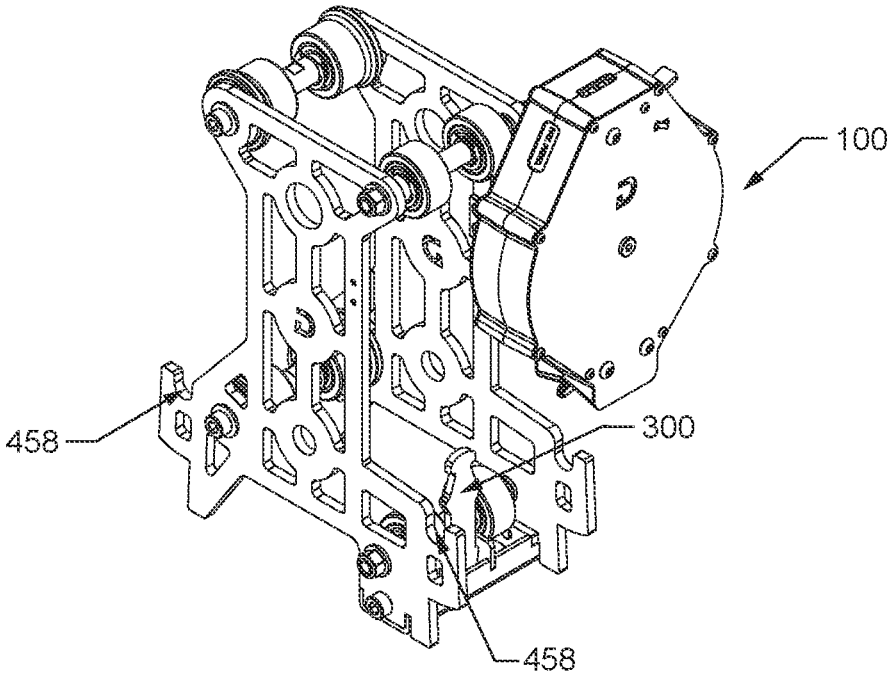
Figure 26I:
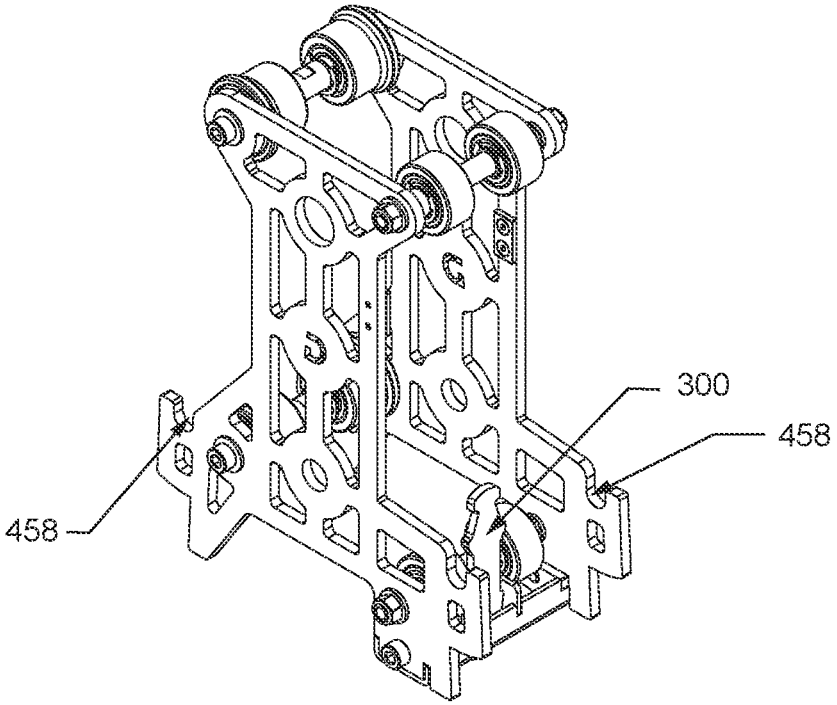
Figure 26J:
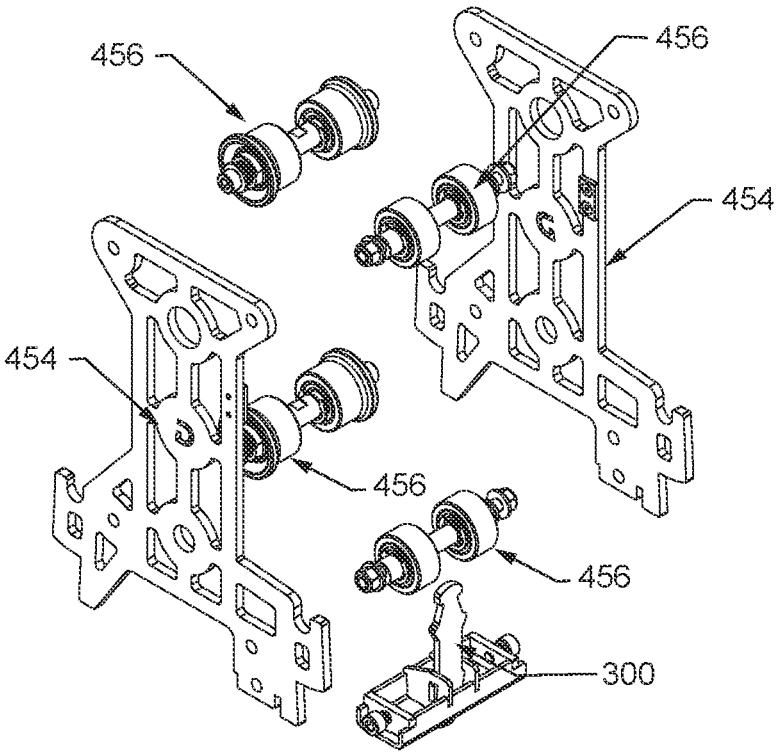

As shown in FIG. 26C-FIG. 26E, in order to remove one or more of the weight horns 452 form the trolley 450, the user rotates the weight horn 452 upward as shown and lifts the weight horn away from the cradle 458, thereby disengaging the pin 453 of the weight horn from the cradle 458 of the trolley.

As shown in FIG. 26A-FIG. 26I for instance, in order to release the fitness cable tensioning apparatus 100 from the trolley, a user actuates one or more release actuators 179 (also see FIG. 5 for instance) and lifts the fitness cable tensioning apparatus 100 away from the trolley. Actuation of the one or more release actuators uncouples the first connector portion (e.g. a female buckle 178) from the second connector portion (e.g. a male connector portion 300) interconnected to the trolley 450.

As shown in FIG. 26G-FIG. 26J for instance, in one or more embodiments the trolley 450 is configured to slidably and/or rollably travel longitudinally along a post 216 of a rack. One or more embodiments of the present disclosure comprise one or more rollers 456 located between the plates 454 of the trolley. In one or more embodiments, one or more rollers 456 are configured to be non-adjustable rollers (e.g. standard rollers mounted to a standard shaft). In one or more embodiments, one or more rollers are configured to be adjustable to allow the adjustment of rollers inward, for instance to accommodate the difference in tolerances between different manufacturers of racks. The adjustable rollers allow a user to precisely adapt their trolley 450 to their rack wherein the trolley does not have any lateral play and thus eliminating any rattling or binding that may occur as a result. A trolley optionally comprises at least two adjustable rollers 456 wherein the two adjustable rollers are interconnected to the trolley 450 on one side of the trolley 450 wherein the adjustable rollers are vertically aligned.

Figure 27A:
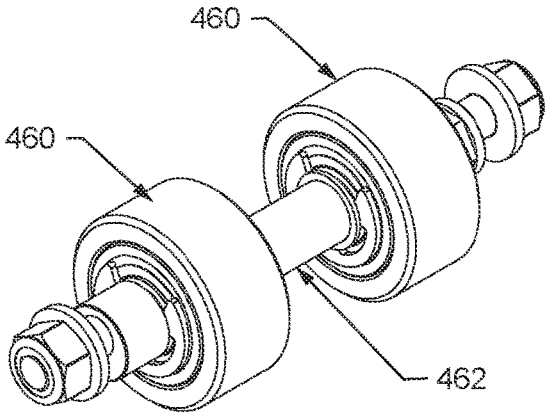
Figure 27B:
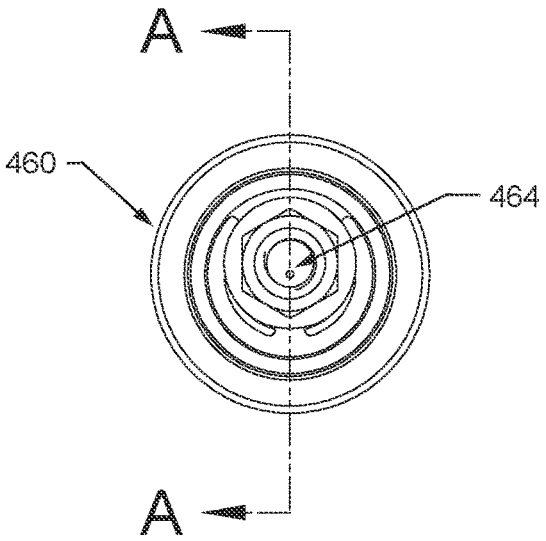
Figure 27C:
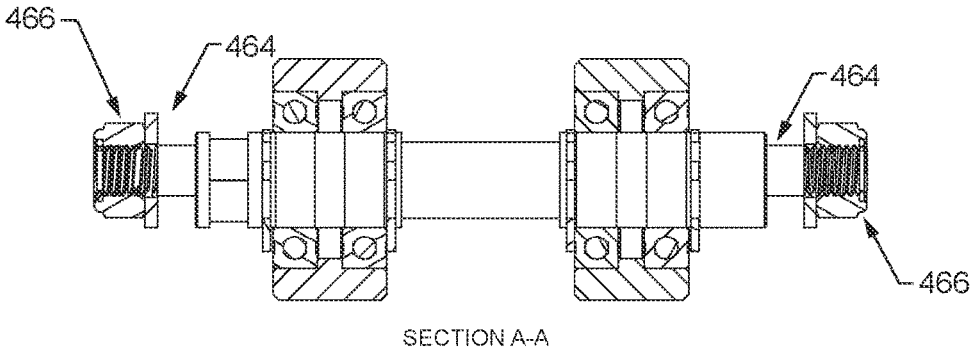

In one or more embodiments, as shown in FIG. 27A-FIG. 27C for instance, adjustable rollers comprise a first wheel 460 and a second wheel 460 mounted to a shaft 462 wherein the shaft 462 is eccentrically interconnected to a stud. Accordingly, when the stud 464 is passed through the plate 454 (see FIG. 26J) and a nut 466 affixed to the stud 464, the rotation of the shaft 462 results in the adjustment of the distance 468 (see FIG. 26G) between the rollers to receive the post 216.

In one or more embodiments, a fitness cable tensioning apparatus 100 as described herein comprises a housing which surrounds a spool within a housing. The housing is configured to protect the spool and other internal components of the fitness cable tensioning apparatus, as well as protect users from having fingers, clothing, and other objects caught within the moving parts of the internal components of the fitness cable tensioning apparatus of the present disclosure.

In one or more embodiments, shown in FIG. 1-FIG. 8 and FIG. 28A-FIG. 28F for instance, the spool 136 comprises a first flange 148 on a first side of the spool, a second flange 148 on a second side of the spool, and an annular recess 137 located between the first flange and the second flange. In one or more embodiments of the present disclosure, a fitness cable 160 tensioning apparatus optionally comprises a spool 136 configured to engage with, collect, and release a cable 160 or flexible tether (used interchangeably herein) from a rotational element (e.g. drum, cylinder) to allow the extension and retraction of the cable from the spool 136 to allow the adjustability of the length of the cable 160. The cable, in one or more embodiments, comprises a first end 161 interconnected to the spool, and a second end 163 configured to extend away from the spool. A "cable" as referred to herein surrounds the use of a cable which is configured to withstand a tensile load. While a cable is commonly understood to include a thick rope (e.g. braided) comprising a wire or non-metallic fiber, as used herein, a cable additionally includes elements such as, but not limited to, webbing (e.g. polyester webbing), cordage, and other forms of flexible tensile tethering elements. In one or more embodiments the cable of one or more embodiments optionally comprises a plastic-coated steel cable.

In one or more embodiments, as shown, the spool optionally comprises a cylindrical form (e.g. a hub 150) for which the cable 160 is configured to wrap around the perimeter (e.g. circumference) or the spool. Embodiments wherein the hub 150 comprises an outer perimeter comprising a radiused concavity thereby resulting in an annular radiused recess (e.g. U-shaped, semi-circular) in the outer perimeter of the spool configured to guide the cable around the spool, are within the spirit and scope of the present disclosure. Alternately, or additionally, a hub 150 optionally comprises a V-shaped concavity around the outer perimeter, thereby resulting in an annular V-shaped recess in the outer perimeter of the spool configured to guide the cable around the spool.

In one or more embodiments of the present disclosure, a spool optionally comprises one or more flanges 148 which are interconnected to the spool. The flanges are configured to guide a cable or flexible tether as it is wound onto the spool 136 as the spool is rotated, or optionally as the tether is round around a static spool. In one or more embodiments the flanges 148 are configured to be perpendicular to an axis of rotation 139 (see FIG. 2) of the spool. In one or more embodiments the flanges 148 comprise a circular shape which is larger than the spool, thereby resulting in a recess 137 between the flanges which coincides with the outer perimeter (e.g. circumference) of the spool. In one or more embodiments the spool flanges, as shown, are optionally circular, however alternate embodiments comprising flanges of alternate shapes are within the spirit and scope of the present disclosure.

In one or more embodiments of the present disclosure, still referencing in FIG. 1-FIG. 8 and FIG. 28A-FIG. 28F for instance, a spool 136 optionally comprises a geared element (e.g. a flange 148 with gear teeth 149) interconnected thereto. A geared element as described herein provides a mechanism, in conjunction with a pawl 130, to optionally allow rotation of the spool 136 in a first rotational direction 401, and optionally allow rotation of the spool in a second rotational direction 402. Such a mechanism is commonly referred to as a ratchet, wherein a pawl allows the rotation of a rotational element in a first rotational direction, but restricts rotation of the rotational element in a second to allow the application of a load, such as found in a ratcheting wrench for instance.

In one or more embodiments of the present disclosure, the geared element, in conjunction with a pawl 130 provides a ratcheting mechanism. The resulting ratcheting mechanism allows the rotation of the spool 136 in a first rotational direction 401 but does not allow the rotation of the spool in a second rotational direction 402, such that the rotation of the spool 136 in the first rotational direction 401 results in the retraction of the cable 160 onto the spool 136 and rotation of the spool 136 in a second would result in the extension of the cable 160 from the spool. When the spool 136 is configured to restrict rotation in the second direction 402 to allow the use of the fitness cable tensioning apparatus in a fitness-based movement to lift a load (e.g. weights, fitness band resistance). In one or more embodiments of the present disclosure, the ratcheting mechanism optionally allows the rotation of the spool in both the first rotational direction 401 and the second rotational direction 402 to allow the adjustment of the cable length in relation to the length of cable between the second end 163 of the cable and the spool 136. Furthermore, in one or more embodiments of the present disclosure, the resulting ratcheting mechanism (e.g. flange 148 with gear teeth 149 in conjunction with a pawl 130) is optionally configurable to restrict the rotation of the spool 136 in the first rotational direction 401 and the second rotational direction 402.

In one or more embodiments of the present disclosure, one or more geared elements is incorporated with at least one perimeter of a flange (e.g. flange 148 with geared teeth 149 around the edge or perimeter), however alternate embodiments wherein the geared element is a separate element assembled to the spool 136 or flange 148 are within the spirit and scope of the present disclosure. In one or more embodiments comprising two flanges 148 as shown in FIG. 3 for instance, wherein each flange 148 comprises a geared element(e.g. geared teeth 149) resulting in two geared elements on either side of the spool 136.

While embodiments shown and described herein describe a mechanism to limit, or restrict rotational movement of the spool in one or more directions comprise a geared element (e.g. flange 148 with gear teeth 149) and pawl 130, alternate embodiments comprising alternate mechanisms to limit or restrict rotation of the spool 136 in one or more directions are within the spirit and scope of the present disclosure. Such alternate mechanisms include a sprag clutch, a one-way sprocket clutch, bearing clutch, and other mechanisms configured to limit or restrict the rotation of a rotational element in one or more rotational directions.

Figure 28E:
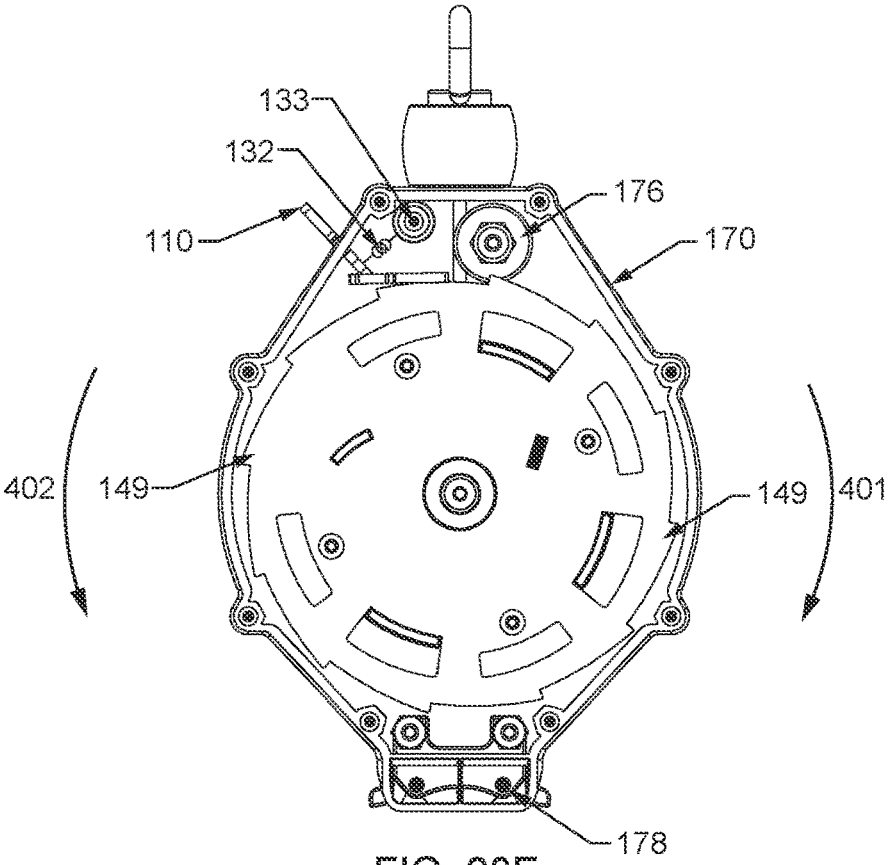

One or more embodiments of the present disclosure, illustrated in FIG. 1-FIG. 8 and FIG. 28A-FIG. 28F for instance, comprises a pawl 130 configured to intermesh with the gear teeth 149 of the first geared element, wherein when the pawl 130 is intermeshed with the gear teeth 149 as shown in FIG. 28E, the pawl allows rotation of the spool in a first rotational direction 401 and does not allow rotation of the spool in a second rotational direction 402, opposite the first rotational direction.

Figure 28F:
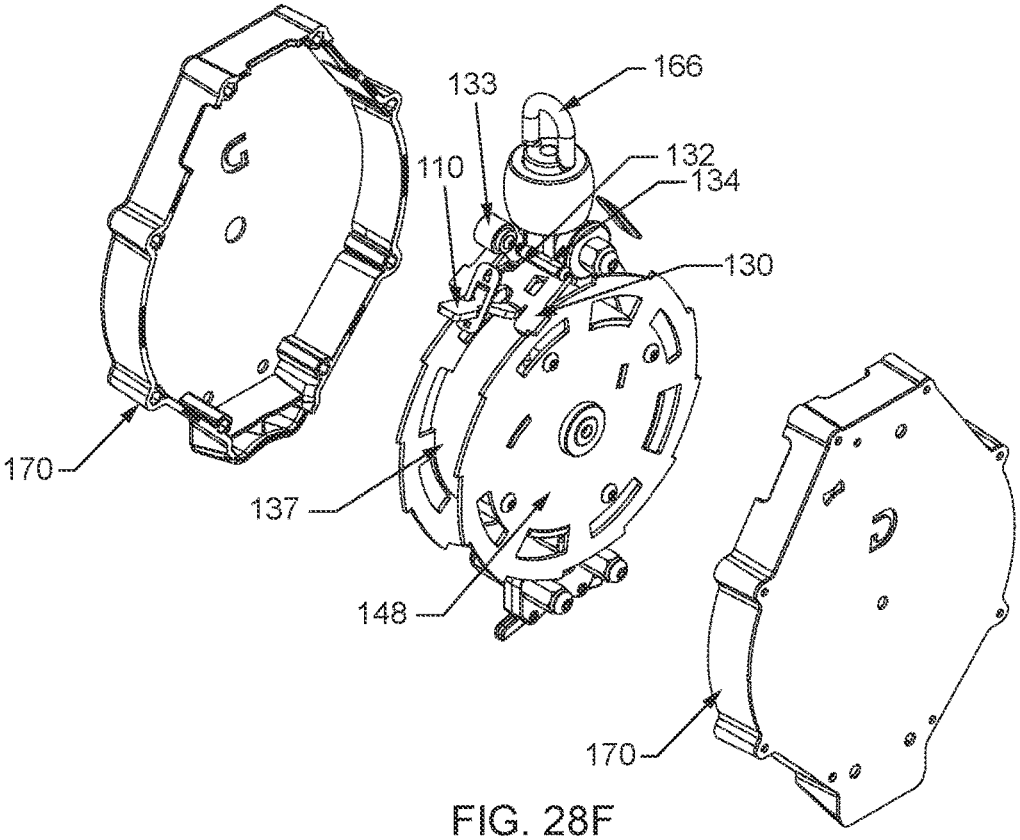
Figure 29:
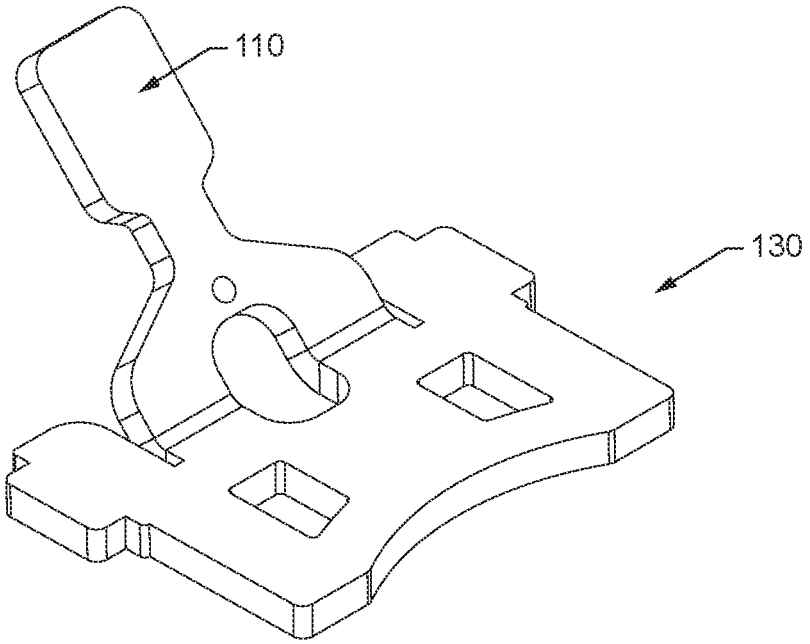

In one or more embodiments of the present disclosure, illustrated in FIG. 28E-FIG. 28F for instance, a pawl 130 is optionally interconnected with the housing wherein the pawl optionally allows or restricts the rotation of the spool 136 in one or more rotational directions. The pawl 130 is configured to engage with the geared element to optionally allow or restrict the rotation of the spool. In one or more embodiments, when the pawl is in a locked configuration, as shown in FIG. 28E, the pawl allows the rotation of the spool 136 in a first rotational direction 401, but restricts the rotation of the pawl in the second rotational direction 402, the pawl intermeshes with (e.g. is in contact with) the geared element wherein the gear teeth 149 are configured to rotate past the pawl 130 in the first rotational direction 401, but catch on the pawl in the second rotational direction 402. In one or more embodiments of the present disclosure, the pawl 130 is configured to intermesh with a single geared element. Alternate embodiments comprise a pawl 130 configured to intermesh with multiple geared elements simultaneously, such as shown in FIG. 28F. Furthermore, embodiments comprising a plurality of pawls 130 configured to intermesh with one or more geared elements are within the spirit and scope of the present disclosure.

One or more embodiments of the present disclosure, such as those illustrated in FIG. 1-FIG. 8 and FIG. 28A-FIG. 28F for instance, comprises a flexible tether (e.g. cable 160) having a first end 161 interconnected to the spool 136 (e.g. at hub 150), and a second end 163 of the flexible tether extending away from the spool 136 at a first end 101 of the housing, wherein the flexible tether is configured to wrap around the spool within the annular recess 137. In one or more embodiments of the present disclosure, a flexible tether (e.g. a cable 160) comprises a first end 161 interconnected with the spool 136 and a second end 163 configured to extend away from the spool. When the spool 136 is rotated in the first rotational direction 401, the cable 160 is drawn and wound onto the spool 136, thereby reducing the relative length of the cable as related to the length of cable 160 outside the spool between the second end 163 of the flexible tether and the fitness cable tensioning apparatus 100. When the spool 136 rotates in the second rotational direction 402, the cable 160 is unwound from the spool and results in increasing the relative length of the flexible as related to the length of cable 160 outside the spool between the second end 163 of the flexible tether and the fitness cable tensioning apparatus 100. The relative length of the cable as discussed herein relates to the length of flexible tether extending outside of the spool, such as the length of cable optionally desired or established by a user for a particular fitness movement.

In one or more embodiments of the present disclosure, the flexible tether is configured to extend outward from the spool and through a first end 101 of the housing. In one or more embodiments of the present disclosure, the housing 170 comprises an aperture 196 wherethrough the flexible tether extends through.

In one or more embodiments of the present disclosure, as illustrated in FIG. 1-FIG. 8 and FIG. 28A-FIG. 28F for instance, the spool 136 comprises a power spring 152 configured to rotate the spool 136 in the first rotational direction. A power spring (e.g. clock spring, power spring, torsion spring) of the present disclosure is configured to rotate the spool 136 in a first rotational direction 401 and thereby wind the flexible tether onto the cable. In one or more embodiments the power spring 152 is housed within a hollow aspect of the spool (e.g. within hub 150).

When an opposing force equal to or greater than the force applied by the power spring 152 is applied to counteract the force of the power spring, the flexible tether is not drawn into the fitness cable tensioning apparatus 100 and onto the spool. For instance, when the spool 136 is limited to rotation in the first rotational direction 401 (e.g. in a locked configuration), a user pulling on the second end of the flexible tether, or the second end of the tether being restricted by a structure (e.g. a rack to which the fitness cable tensioning apparatus is mounted to) prevents the power spring 152 from retracting the flexible tether. The power spring 152 allows for convenient and easy retraction of the flexible tether onto the spool for situations, such as when reconfiguring the fitness cable tensioning apparatus from a first exercise to a second exercise wherein less relative length of the flexible tether is required. Furthermore, in one or more embodiments when the spool is permitted to rotate in the second rotational direction 402 (e.g. in an unlocked configuration), a user can pull on the second end 163 of the flexible tether to counteract and overcome the force of the power spring 152 to increase the relative length of the flexible tether when reconfiguring from a first exercise to a second exercise wherein more relative length of the flexible tether is required.

One or more embodiments of the present disclosure comprise a pawl toggle 110, wherein when the pawl toggle 110 is in a first position (e.g. directed to locked icon 112), the pawl is in a locked configuration, and wherein when the toggle is in a second position (e.g. pointed to unlocked icon 114), the pawl is in an unlocked configuration. When the pawl is in the locked configuration, the pawl intermeshes with the gear teeth, and wherein the pawl is in a locked position allowing rotation of the spool only in the first rotational direction. Furthermore, when the pawl 130 is in the unlocked position, the pawl 130 is not intermeshed with the gear teeth 149, and thereby allows the rotation of the spool in the first rotational direction 401, and second rotational direction 402.

In one or more embodiments, a pawl toggle 110, interconnected with the pawl 130, allows a user to configure the pawl 130 in one or more configurations which optionally restrict one or more rotational directions of the spool. When the pawl toggle 110 is optionally placed in a first position, the pawl toggle 110 places the pawl 130 in a locked configuration (see FIG. 28E), thereby engaging the pawl 130 with the gear teeth 149 which results in allowing the rotation of the spool 136 in a first rotational direction 401, and restricting the rotation of the spool in the second rotational direction 402. When the pawl toggle 110 is optionally placed in a second position (see FIG. 28D), the pawl toggle 110 places the pawl 130 in an unlocked configuration, thereby disengaging the pawl 130 from the gear teeth 149 which results in allowing the rotation of the spool in a first rotational direction 401 and a second rotational direction 402. Additionally or alternatively, in one or more embodiments a pawl toggle 110 is optionally placed in a third position (not shown) which results in the pawl 130 to engage with the gear teeth 149 in a manner which restricts the rotation of the spool in either of the first rotational direction 401 or the second rotational direction 402.

One or more embodiments of the present disclosure, as illustrated in FIG. 1-FIG. 8 and FIG. 28A-FIG. 28F for example, comprise a fitness cable tensioning apparatus 100 further comprises a cable guide 176 located between the first end 101 of the housing and the spool 136. The cable guide 176 is configured to guide the flexible tether (e.g. cable 160) as it extends away from the spool and retracts toward the spool. The cable guide 176 of one or more embodiments comprises a roller configured to guide the cable as it extends away from the housing and the spool in a manner to prevent frictional damage to the cable, the spool, and/or the housing. The cable guide 176 in one or more embodiments comprises a rotational element such as a cylinder, V-grooved wheel comprising V-shaped annular recess, a U-grooved wheel comprising a U-shaped annular recess, or other shape configured to guide a cable or flexible tether, wherein the cable guide rotates as the flexible tether extends away from or retracts onto the spool. Alternatively, in one or more embodiments of the present disclosure, a cable guide optionally comprises a static element which comprises a low coefficient of friction (i.e. high lubricity) such as brass, acetal plastic, polytetrafluoroethylene (PTFE), or the like.

In one or more embodiments of the present disclosure, a fitness cable tensioning apparatus comprises a first connector portion (e.g. female buckle portion 178) at a second end of the housing. The second end 102 of the housing is typically located opposite the first end 101, wherein if the fitness cable tensioning apparatus 100 is suspended by the cable extending out from the first end 101 of the housing, the second end 102 of the housing is vertically opposite the first end. However, alternate embodiments wherein the first end 101 and the second end 102 of the housing are differently configured as within the spirit and scope of the present disclosure.

The first connector portion (e.g. female buckle 178) is configured to allow the quick attachment to one or more alternate devices to further augment a fitness movement. For instance, the female buckle 178 shown is configured to interconnect to one or more devices which are configured to have an applied load (e.g. weights, load bands). The female buckle 178 allows the interconnection of the fitness cable tensioning apparatus to a second connector portion (e.g. a male buckle portion 300) as shown in FIG. 18, FIG. 20, and FIG. 28F-FIG. 28J. By connecting the female buckle portion 178 to the male buckle portion 300 for instance, the fitness cable tensioning apparatus 100 is optionally connected to a load pin 210, wherein the load pin allows the loading of one or more weights (e.g. weight plates) and subsequently interconnect the fitness cable tensioning apparatus to the load pin. In one or more embodiments of the present disclosure, the first connector portion allows the interconnection of the fitness cable tensioning apparatus to a second connector portion interconnected with a trolley 450 which is configured to slidably interconnect to an upright post 216 of a rack wherein the trolley 450 is configured for loading one or more weights (e.g. weight plates).

The first connector portion of one or more embodiments of the present disclosure is configured to allow quick-connect and quick-disconnect actions without the use of tools to connect or disconnect the first connector portion from a second connector portion rapidly.

Figure 30A:
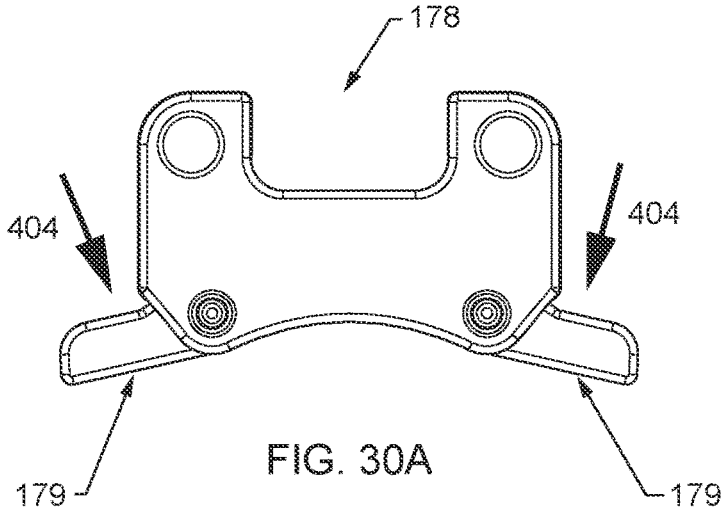
Figure 30B:
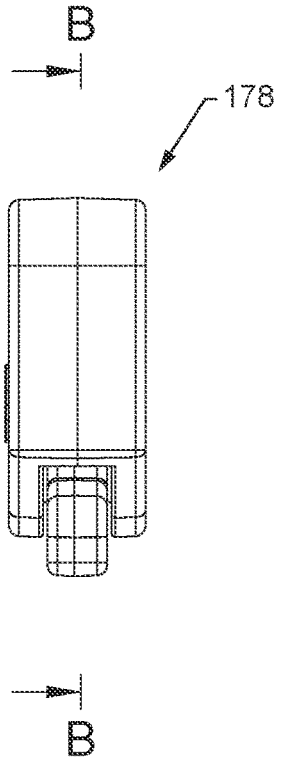
Figure 30C:
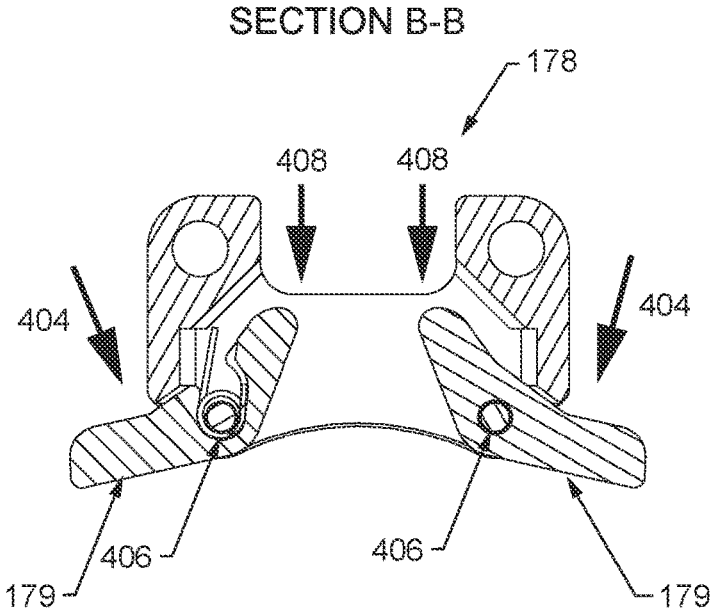

In one or more embodiments of the present disclosure, the first connector portion 178 is configured to retain a second connector portion interconnected thereto when the first connector portion is in a locked configuration. In one or more embodiments of the present disclosure, when the first connector portion is interconnected to a second connector portion, the first connector portion defaults to a locked configuration (shown in FIG. 30A-FIG. 30C) until otherwise actuated by a user. For instance, a first connector portion comprises one or more release actuators 179 wherein the release actuators comprise an internal spring 406 which apply a force configured to place the release actuators in a locked configuration. When a force 404 is applied to the release actuators in a manner to overcome the force applied by the springs 406, the release actuators are placed in an unlocked configuration.

One or more embodiments of the present disclosure comprise a first connector portion 178 further comprising one or more connector release actuators 179, wherein user actuation of the one or more release actuators places the first connector portion in an unlocked configuration. Furthermore, in one or more embodiments, the first connection portion mitigates the unintentional release of the fitness cable tensioning apparatus to an alternate device to which it is interconnected. For instance, a load (e.g. weights 212 on a load pin 210, FIG. 23) connected to the first connector of certain embodiments results in a force 408 being applied to the release actuators which is counteractive to the force 404 needed to actuate the release actuators 179 to unlock the female buckle portion 178. Therefore, in order to release the female buckle portion 178 from the male buckle portion 300 under load, the force 404 applied to the release actuators must be applied in a manner to overcome the force 408 applied by the load (e.g. weight of a load pin, and weights on the load pin) in addition to overcoming the force applied by the springs 406 configured to place the actuators in a locked configuration.

In one or more embodiments of the present disclosure the first connector portion comprises a female buckle connector configured to interconnect to and retain the second connector portion which comprises a male buckle connector. In one or more embodiments of the present disclosure, the first connector portion comprises a female buckle connector configured to releasably interconnect with a second buckle connector wherein the second buckle connector comprises a male buckle connector. While embodiments shown comprise male and female buckle connectors and the interconnectability therebetween, alternate embodiments wherein the first connector portion comprises a male buckle connector, or alternate embodiments wherein the alternate connection methods are within the spirit and scope of the present disclosure. Alternate embodiments include, but are not limited to a first connector portion and second connector portion comprising: clevis pin through a cross-drilled shaft, hook and webbing loop, spring hook and eyelet, and other connector strategies.

In one or more embodiments of the present disclosure, as shown in FIG. 1-FIG. 8 and FIG. 28A-FIG. 28F for instance, the pawl toggle 110 extends outward from an external aspect of the housing 170 of the fitness cable tensioning apparatus. The extension of the pawl toggle 110 outward away from the external aspect of the housing 170 allows for the ease of manipulation by a user to alternatingly place the pawl toggle in a locked configuration or an unlocked configuration. In one or more embodiments (see FIG. 1-FIG. 8) the pawl toggle extends outward from a lateral surface (e.g. back plate 168) wherein the lateral surface is typically parallel with the one or more flanges 148 of the spool. In one or more embodiments (see FIG. 28A-FIG. 28F) the pawl toggle alternatively extends outward from a radial surface (e.g. through housing 170) wherein a radial surface is typically placed radially outward from the spool.

In one or more embodiments of the present disclosure, the pawl toggle 110 is located proximal to a first end 101 of the housing wherein when the fitness cable tensioning apparatus 100 is suspended from the cable, it results in the pawl toggle 110 being located on a top portion of the housing 170 thereby providing easy access to user, and allowing a user to easily view the configuration which the pawl toggle 110 is in, indicating whether the toggle is in a locked configuration or an unlocked configuration.

In one or more embodiments of a fitness cable tensioning apparatus, shown for instance in FIG. 1-FIG. 8, and FIG. 28A-FIG. 28F) when the pawl is in an unlocked configuration, a pawl limiting device (e.g. spring 132, magnet 133) limits transition of the pawl away from at least one of the locked configuration and the unlocked configuration. In one or more embodiments of the present disclosure, the fitness cable tensioning apparatus comprises a first pawl limiting device. A pawl limiting device prevents inadvertent transition of the pawl 130 from a locked configuration to an unlocked configuration, or a transition of the pawl 130 from an unlocked configuration to a locked configuration. For instance the inadvertent transition of the pawl 130 from a locked configuration to an unlocked configuration when under load could result in injury to a user and/or damage to surrounding equipment. In one or more embodiments the first pawl limiting device is configured to maintain the pawl 130 in locked configuration. In alternate configurations, the first pawl limiting device is configured to maintain the pawl 130 in an unlocked configuration. In one or more embodiments of the present embodiments, a fitness cable tensioning apparatus comprises a first pawl limiting device and a second pawl limiting device wherein the first pawl limiting device is configured to maintain the pawl 130 in a locked configuration when the pawl 130 is placed in a locked configuration, and wherein the second pawl limiting device is configured to maintain the pawl 130 in an unlocked configuration when the pawl 130 is placed in an unlocked configuration.

In one or more embodiments of the present disclosure, FIG. 1-FIG. 8, and FIG. 28A-FIG. 28F, a first pawl limiting device is configured to maintain the pawl 130 in a locked configuration when the pawl 130 is placed in a locked configuration, and maintain the pawl 130 in an unlocked configuration when the pawl 130 is placed in an unlocked configuration. Take for instance, a spring 132 in an "over-center" configuration wherein the extension spring 132 is configured to apply a first force when the pawl is in the unlocked configuration, and a second force when the pawl is in the unlocked configuration. Furthermore, when the pawl is in an intermediate (e.g. center) position between the locked configuration and the unlocked configuration, the spring applies a third force, greater than the first force or the second force. Thus, in order to transition from a locked or unlocked configuration to the opposite configuration, a user must apply a force to overcome the third force (applied by the spring 132 in an intermediate configuration) as the pawl 130 passes through the intermediate position as the spring passes "over-center". In such a manner, a spring 132 which interconnects between the pawl 130 and the housing 170 (e.g. by way of a rod 134 interconnected to the housing) the spring 132 is optionally configured to mitigate the inadvertent transition of the pawl out of the intended configuration (e.g. locked, unlocked). While an exemplary configuration is offered surrounding an over-center spring which acts as a single pawl limiting device to prevent inadvertent transition out of an intended configuration (e.g. locked, unlocked), alternate configurations to prevent inadvertent transition between the unlocked and locked configurations, including over-center mechanisms, are within the spirit and scope of the present disclosure.

In one or more embodiments of the present disclosure, the first pawl limiting device comprises a magnet 133 wherein the pawl 130 comprises magnetic characteristics such that when the pawl 130 is placed in an unlocked or locked configuration, the magnetic field of the magnet 133 is configured to maintain the pawl 130 in the intended configuration.

In one or more embodiments of the present disclosure, the second end 163 of the cable of the fitness cable tensioning apparatus comprises an eyelet 166 which provides a provision which a user can connect a handle (206, FIG. 23) or other device which a user can apply a load to. In one or more embodiments a user can interconnect a handle to the eyelet by way of a hook, spring hook, or carabiner for instance.

In one or more embodiments of the present disclosure, as illustrated in FIG. 1-FIG. 8 and FIG. 28A-FIG. 28F for instance, a bumper is interconnected to the flexible tether wherein the bumper 164 is configured to provide cushion between the second end 163 of the flexible tether and the aperture of the housing. In one or more embodiments the bumper comprises a dimension (e.g. width, diameter) which is larger than a dimension (e.g. width, diameter) of the aperture of the housing. Accordingly, the bumper is prevented from entering the aperture and prevents the second end of the flexible tether from impacting the housing, thus preventing the second end of the tether from entering the aperture of the housing.

While various embodiments of the present disclosure have been described in detail, it is apparent that modifications and alterations of those embodiments will occur to those skilled in the art. However, it is to be expressly understood that such modifications and alterations are within the scope and spirit of the present disclosure. Further, the disclosures described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A fitness cable tensioning apparatus comprising:

a housing having first and second ends;

a spool within the housing, the spool comprising a first flange on a first side of a hub, a second flange on a second side of the hub, and an annular recess located between the first flange and the second flange;

a first geared element interconnected to the spool, wherein the first geared element comprises a plurality of gear teeth;

a pawl configured to intermesh with the gear teeth of the first geared element, wherein when the pawl is intermeshed with the gear teeth, the pawl allows rotation of the spool in a first rotational direction and does not allow rotation of the spool in a second rotational direction, opposite the first rotational direction;

a flexible fitness cable suitable for conveying a fitness exercise load, the flexible fitness cable having a first end interconnected to the spool, and a second end of the flexible fitness cable extending away from the spool at a first end of the housing, wherein the flexible fitness cable is configured to wrap around the spool within the annular recess;

a power spring interconnected to the spool, wherein the power spring is configured to rotate the spool in the first rotational direction about a rotational axis of the spool; and a pawl toggle, wherein when the pawl toggle is in a first position, the pawl is in a locked configuration, and wherein when the pawl toggle is in a second position, the pawl is in an unlocked configuration; and a permanent magnet configured to passively hold the pawl in a first selected one of the locked and unlocked configurations when the pawl toggle is moved to the position corresponding to the first selected configuration;

wherein when the pawl is in the locked configuration, the pawl intermeshes with the gear teeth allowing rotation of the spool only in the first rotational direction, and when the pawl is in an unlocked position, the pawl is not intermeshed with the gear teeth, and thereby allows the rotation of the spool in the first rotational direction, and second rotational direction.

2. The fitness cable tensioning apparatus of claim 1, further comprising a cable guide roller positioned within the housing and located between the first end of the housing and the spool, wherein the cable guide roller is configured to guide the flexible fitness cable as it extends away from the spool and retracts toward the spool such that a first axis that is co-axial with a longitudinal axis of the flexible fitness cable exiting the housing is aligned to pass through the hub of the spool.

3. The fitness cable tensioning apparatus of claim 1, further comprising a spring configured to help hold the pawl in a second one of the locked or unlocked configurations when the pawl toggle is moved to the position corresponding to the selected configuration.

4. The fitness cable tensioning apparatus of claim 1, further comprising a first buckle connector portion attached to the housing at a second end of the housing, opposite the first end of the housing, the first buckle connector portion being configured to interconnect with a second connector buckle connector portion that is interconnected to a load, the first and second buckle connector portions together forming a buckle that secures a load bearing device to the second end of the housing opposite the first end of the housing from which the flexible fitness cable extends such that selected user movements of a handle interconnected to a second end of the cable with the pawl in the locked position causes movement of the fitness cable tensioning apparatus and the load.

5. The fitness cable tensioning apparatus of claim 1, wherein the pawl toggle extends outward from an external aspect of the housing.

6. The fitness cable tensioning apparatus of claim 5, wherein the pawl toggle extends outward from a lateral surface of the external aspect of the housing.

7. The fitness cable tensioning apparatus of claim 5, wherein the pawl toggle extends through a radial surface of the external aspect of the housing.

8. The fitness cable tensioning apparatus of claim 5, wherein pawl toggle is located proximal to the first end of the housing.

9. The fitness cable tensioning apparatus of claim 3, wherein the spring is a center-loaded spring that helps hold the pawl in the locked position when the pawl is toggled to the locked position, and helps hold the pawl in the unlocked position when the pawl is toggled to the unlocked configuration.

10. The fitness cable tensioning apparatus of claim 1, further comprising an eyelet interconnected to the second end of the flexible fitness cable.

11. The fitness cable tensioning apparatus of claim 10, further comprising:

an aperture in the first end of the housing wherethrough the flexible fitness cable extends; and a bumper interconnected to the flexible fitness cable between the first end of the flexible fitness cable and the second end of the flexible fitness cable, wherein the bumper comprises a width greater than one or more dimensions of the aperture.

12. The fitness cable tensioning apparatus of claim 1, wherein the first geared element is coincident with an edge of the first flange.

13. The fitness cable tensioning apparatus of claim 12, further comprising a second geared element coincident with an edge of the second flange, wherein the pawl is configured to intermesh with the first geared element and the second geared element simultaneously when the pawl is in a locked configuration.

14. A fitness method using the fitness cable tensioning apparatus of claim 1 comprising:

interconnecting the fitness cable tensioning apparatus to a load bearing device, wherein the load bearing device is configured to travel upward and downward along an upright structure;

configuring the fitness cable tensioning apparatus in an unlocked configuration;

modifying a relative length of the flexible fitness cable in relation to the fitness cable tensioning apparatus through one or more pulleys;

configuring the fitness cable tensioning apparatus in a locked configuration; and interconnecting a handle to the second end of the flexible fitness cable, wherein applying tension to the handle applies a force which corresponds to slidably raising the load bearing device upward.

15. An exercise equipment cable system comprising:

a fitness cable having first and second ends, the first fitness cable end being attachable to or attached to a handle;

a load bearing device; and a ratchet-based cable tensioning apparatus attached to the second end of the fitness cable and to the load bearing device, the cable tensioning apparatus including a housing and a ratchet mechanism having a locked state and an unlocked state, wherein the cable tensioning apparatus maintains tension on the fitness cable in both the ratchet mechanism locked and unlocked states, and wherein when the ratchet mechanism is in the locked state, a user pulling the fitness cable using the handle causes the load bearing device to move thereby applying a exercise load to the handle via the fitness cable and when the ratchet mechanism is in the unlocked state, a length of a free portion of the fitness cable may be adjusted without moving the load bearing device; and wherein the housing includes an aperture at a first end of the housing through which the fitness cable passes and the load bearing device is coupled to a second end of the housing opposite the first end of the housing; and wherein the ratchet mechanism includes:

a spool within the housing, the spool comprising a first flange on a first side of a hub, a second flange on a second side of the hub, and an annular recess located between the first flange and the second flange, wherein a portion of the fitness cable at the second end of the fitness cable is configured to wrap around the spool within the annular recess, and wherein the fitness cable extends away from the cable tensioning apparatus via the aperture at the first end of the housing;

a power spring interconnected to the spool, wherein the power spring is configured to rotate the spool in a first rotational direction; and a first geared element interconnected to the spool, wherein the first geared element comprises a plurality of gear teeth;

a pawl configured to intermesh with the gear teeth of the first geared element, wherein when the pawl is intermeshed with the gear teeth, the pawl allows rotation of the spool in the first rotational direction and does not allow rotation of the spool in a second rotational direction, opposite the first rotational direction; and a pawl toggle, wherein when the pawl toggle is in a first position, the pawl is in a locked configuration with the pawl intermeshing with at least one of the gear teeth thereby allowing rotation of the spool only in the first rotational direction thereby placing the ratchet mechanism in the locked state, and wherein when the pawl toggle is in a second position, the pawl is in an unlocked configuration thereby allowing rotation of the spool in both the first and second rotational directions and thereby placing the ratchet mechanism in the unlocked state.

16. The exercise equipment cable system of claim 15, wherein the ratchet mechanism further comprises a cable guide roller positioned within the housing and located between the first end of the housing and the spool, wherein the cable guide roller is configured to guide the flexible fitness cable as it extends away from the spool and retracts toward the spool such that a first axis that is co-axial with a longitudinal axis of the flexible fitness cable exiting the housing is aligned to pass through the hub of the spool.

17. The exercise equipment cable system of claim 16, further comprising a buckle having a first buckle connector portion and a second buckle connector portion, wherein:

the first buckle connector portion is to the housing at the second end of the housing, opposite the first end of the housing, and the second buckle connector portion is coupled to the load bearing device;

the first buckle connector portion is configured to engage with the second buckle connector portion to attach the load bearing device to the cable tensioning apparatus at the second end of the housing; and the first axis further passes through the first buckle connector portion such that the first buckle is centered around the first axis; and whereby when the ratchet mechanism is in the locked state and the first and second buckle connector portions are engaged, the user pulling the fitness cable using the handle causes the load bearing device to move thereby applying the exercise load to the handle via the cable tensioning apparatus and the fitness cable.

18. An exercise equipment cable system as recited in claim 15 further comprising a magnet configured to passively hold the pawl in a first selected one of the locked and unlocked configurations when the pawl toggle is moved to the position corresponding to the first selected configuration.

19. A ratchet-based cable tensioning apparatus configured for use in an exercise equipment system that includes a load bearing device and a handle, bar or attachment that are interconnected, at least in part, via a fitness cable and the ratchet-based cable tensioning apparatus, the ratchet-based cable tensioning apparatus attached to a first end of the fitness cable and comprising:

a ratchet mechanism having a locked state and an unlocked state, wherein the ratchet-based cable tensioning apparatus maintains tension on the fitness cable in both the ratchet mechanism locked and unlocked states, and wherein when the ratchet mechanism is in the locked state with the load bearing device and the handle, bar or attachment interconnected, at least in part, via the fitness cable and the ratchet-based cable tensioning apparatus, a user performing a selected exercise movement that moves the handle, bar or attachment, causes the load bearing device to move thereby applying an exercise load to the handle, bar or attachment, via the fitness cable and the ratchet-based cable tensioning mechanism, and when the ratchet mechanism is in the unlocked state, a length of a free portion of the fitness cable may be adjusted while maintaining tension on the fitness cable, and wherein the ratchet mechanism includes:

a spool within a housing, the spool comprising a first flange on a first side of a hub, a second flange on a second side of the hub, and an annular recess located between the first flange and the second flange, wherein a portion of the fitness cable at the second end of the fitness cable is configured to wrap around the spool within the annular recess, and wherein the fitness cable extends away from the cable tensioning apparatus via an aperture at the first end of the housing;

a power spring interconnected to the spool, wherein the power spring is configured to rotate the spool in a first rotational direction; and a first geared element interconnected to the spool, wherein the first geared element comprises a plurality of gear teeth;

a pawl configured to intermesh with the gear teeth of the first geared element, wherein when the pawl is intermeshed with the gear teeth, the pawl allows rotation of the spool in the first rotational direction and does not allow rotation of the spool in a second rotational direction, opposite the first rotational direction; and a pawl toggle, wherein when the pawl toggle is in a first position, the pawl is in a locked configuration with the pawl intermeshing with at least one of the gear teeth thereby allowing rotation of the spool only in the first rotational direction thereby placing the ratchet mechanism in the locked state, and wherein when the pawl toggle is in a second position, the pawl is in an unlocked configuration thereby allowing rotation of the spool in both the first and second rotational directions and thereby placing the ratchet mechanism in the unlocked state.

20. The ratchet-based cable tensioning apparatus of claim 19, further comprising:

a permanent magnet configured to passively hold the pawl in a first selected one of the locked and unlocked configurations when the pawl toggle is moved to the position corresponding to the first selected configuration; and a spring configured to help hold the pawl in a second one of the locked or unlocked configurations when the pawl toggle is moved to the position corresponding to the second selected configuration.

21. The ratchet-based cable tensioning apparatus of claim 19, further comprising an over center-loaded spring that helps hold the pawl in the locked position when the pawl is toggled to the locked position, and helps hold the pawl in the unlocked position when the pawl is toggled to the unlocked configuration.

22. An exercise equipment system comprising a ratchet-based cable tensioning apparatus as recited in claim 19, the handle, bar or attachment, the fitness cable and the load bearing device.

23. A fitness cable tensioning apparatus comprising:

a housing having first and second ends;

a spool within the housing, the spool comprising a first flange on a first side of a hub, a second flange on a second side of the hub, and an annular recess located between the first flange and the second flange;

a first geared element interconnected to the spool, wherein the first geared element comprises a plurality of gear teeth;

a pawl configured to intermesh with the gear teeth of the first geared element, wherein when the pawl is intermeshed with the gear teeth, the pawl allows rotation of the spool in a first rotational direction and does not allow rotation of the spool in a second rotational direction, opposite the first rotational direction;

a flexible fitness cable suitable for conveying a fitness exercise load, the flexible fitness cable having a first end interconnected to the spool, and a second end of the flexible fitness cable extending away from the spool at the first end of the housing, wherein the flexible fitness cable is configured to wrap around the spool within the annular recess;

a power spring interconnected to the spool, wherein the power spring is configured to rotate the spool in the first rotational direction about a rotational axis of the spool; and a pawl toggle, wherein when the pawl toggle is in a first position, the pawl is in a locked configuration, and wherein when the pawl toggle is in a second position, the pawl is in an unlocked configuration; and a cable guide roller positioned attached to the housing within the housing and located between the first end of the housing and the spool, wherein the cable guide roller is configured to guide the flexible fitness cable as it extends away from the spool and retracts toward the spool such that a first axis that is co-axial with a longitudinal axis of the flexible fitness cable exiting the housing is aligned to pass through the hub of the spool; and wherein when the pawl is in the locked configuration, the pawl intermeshes with the gear teeth allowing rotation of the spool only in the first rotational direction, and when the pawl is in an unlocked position, the pawl is not intermeshed with the gear teeth, and thereby allows the rotation of the spool in the first rotational direction, and second rotational direction.

24. The fitness cable tensioning apparatus of claim 23, further comprising a first buckle connector portion attached to the housing at the second end of the housing, the first buckle connector portion being configured to interconnect with a second buckle connector portion that is interconnected to a load, the first and second buckle connector portions together forming a buckle, wherein the first axis further passes through the first buckle connector portion such that the first buckle is centered around the first axis.

25. A fitness cable tensioning apparatus comprising:

a housing having first and second ends;

a spool within the housing, the spool comprising a first flange on a first side of a hub, a second flange on a second side of the hub, and an annular recess located between the first flange and the second flange;

a first geared element interconnected to the spool, wherein the first geared element comprises a plurality of gear teeth;

a pawl configured to intermesh with the gear teeth of the first geared element, wherein when the pawl is intermeshed with the gear teeth, the pawl allows rotation of the spool in a first rotational direction and does not allow rotation of the spool in a second rotational direction, opposite the first rotational direction;

a flexible fitness cable having a first end interconnected to the spool, and a second end of the flexible fitness cable extending away from the spool at the first end of the housing, wherein the flexible fitness cable is configured to wrap around the spool within the annular recess;

a power spring interconnected to the spool, wherein the power spring is configured to rotate the spool in the first rotational direction about a rotational axis of the spool; and a pawl toggle, wherein when the pawl toggle is in a first position, the pawl is in a locked configuration, and wherein when the pawl toggle is in a second position, the pawl is in an unlocked configuration;

a first buckle connector portion attached to the housing at the second end of the housing, the first buckle connector portion being configured to interconnect with a second buckle connector portion that is interconnected to a load, the first and second buckle connector portions together forming a buckle;

wherein when the pawl is in the locked configuration, the pawl intermeshes with the gear teeth allowing rotation of the spool only in the first rotational direction, and when the pawl is in an unlocked position, the pawl is not intermeshed with the gear teeth, and thereby allows the rotation of the spool in the first rotational direction, and second rotational direction.

* * * * *